US008900031B2

(12) United States Patent
Benedict et al.

(10) Patent No.: US 8,900,031 B2
(45) Date of Patent: Dec. 2, 2014

(54) TOY VEHICLE WITH FLIPPING MECHANISM

(75) Inventors: Bryan Ray Benedict, Torrance, CA (US); Keith Hippely, Manhattan Beach, CA (US); Marlin He, Ganzhou (CN); Anthony M. Martino, Thousand Oaks, CA (US); Eric So, Tsing Yi (HK)

(73) Assignee: Mattel, Inc., El Segundo, CA (US)

( * ) Notice: Subject to any disclaimer, the term of this patent is extended or adjusted under 35 U.S.C. 154(b) by 191 days.

(21) Appl. No.: 13/323,904

(22) Filed: Dec. 13, 2011

(65) Prior Publication Data

US 2012/0322341 A1 Dec. 20, 2012

Related U.S. Application Data

(60) Provisional application No. 61/424,018, filed on Dec. 16, 2010.

(51) Int. Cl.
*A63H 17/00* (2006.01)

(52) U.S. Cl.
USPC ..... 446/437; 446/465

(58) Field of Classification Search
USPC ..... 446/326, 437, 465, 466
See application file for complete search history.

(56) References Cited

U.S. PATENT DOCUMENTS

| | | | | |
|---|---|---|---|---|
| 1,362,248 | A | 12/1920 | Ford | |
| 2,182,642 | A | 12/1939 | Rexford | |
| 2,587,052 | A | 2/1952 | Lohr | |
| 3,816,958 | A | 6/1974 | Winston | |
| 3,892,086 | A | 7/1975 | Gay et al. | |
| 4,363,187 | A | 12/1982 | Shinohara | |
| 4,449,323 | A | 5/1984 | Fisher | |
| 4,466,214 | A | 8/1984 | Kulesza et al. | |
| 4,490,124 | A | 12/1984 | Ogawa | |
| 4,591,346 | A | 5/1986 | Ikeda | |
| 4,705,487 | A | 11/1987 | Ishimoto | |
| 4,850,931 | A | 7/1989 | Auer | |
| 4,894,042 | A | 1/1990 | Kamikawa | |
| 5,019,009 | A | 5/1991 | Chao-Chin et al. | |
| 5,259,808 | A | 11/1993 | Garr | |
| 5,618,219 | A | 4/1997 | Simone et al. | |
| 5,725,412 | A | 3/1998 | Ishimoto | |
| 5,727,986 | A | 3/1998 | Stubenfoll et al. | |
| 6,227,934 | B1 | 5/2001 | Isaksson et al. | |
| 6,881,122 | B2 * | 4/2005 | Bloch et al. | 446/466 |
| 6,939,197 | B1 | 9/2005 | Hoeting | |
| 7,654,879 | B2 | 2/2010 | Dunham | |
| 7,749,047 | B2 | 7/2010 | Dunham | |
| 2003/0224695 | A1 * | 12/2003 | Kislevitz et al. | 446/437 |
| 2009/0149113 | A1 | 6/2009 | Lund et al. | |

FOREIGN PATENT DOCUMENTS

| | | | |
|---|---|---|---|
| GB | 2033766 | A | 5/1980 |

* cited by examiner

*Primary Examiner* — Vishu K. Mendiratta
(74) *Attorney, Agent, or Firm* — Edell, Shapiro & Finnan LLC

(57) ABSTRACT

A toy vehicle includes a vehicle body configured for moving along a support surface when disposed in a first orientation. A platform is rotatably coupled to an underside of the vehicle body, and a lever is pivotally coupled to the platform. The lever is movable between a first position disengaged from the support surface and a second position engageable with the support surface when the vehicle is disposed in its first orientation. The lever causes the vehicle to be overturned from its first orientation when the lever is moved from its first position to its second position.

17 Claims, 24 Drawing Sheets

TOY VEHICLE WITH FLIPPING MECHANISM

CROSS REFERENCE TO RELATED APPLICATION

The present application claims priority to and is based on U.S. Provisional Patent Application Ser. No. 61/424,018, filed Dec. 16, 2010, entitled "Toy Vehicle with Flipping Mechanism," the disclosure of which is incorporated herein by reference in its entirety.

FIELD OF THE INVENTION

The present invention relates to a toy vehicle, and in particular, to a toy vehicle that includes a flipping mechanism for overturning or flipping the toy vehicle in a selected direction.

BACKGROUND OF THE INVENTION

Various wheeled toy vehicles are known in the art. Some toy vehicles include an arm or mechanism that causes the vehicle to roll or tumble in a predetermined direction. While such vehicles provide an additional level of entertainment for a child, there is a need for a toy vehicle that may be overturned in a direction selectable by the child, and that is relatively easy to operate.

SUMMARY OF THE INVENTION

The present invention is directed to a toy vehicle including a vehicle body having an underside. The toy vehicle is configured for moving along a support surface when disposed in a first orientation. A platform is rotatably coupled to the underside of the vehicle body. A lever is pivotally coupled to the platform. The lever is movable between a first position spaced from the support surface to a second position. As the lever moves from its first position toward its second position, the lever contacts the support surface when the vehicle is disposed in its first orientation. The lever causes the vehicle to be overturned or flipped from its first orientation when the lever is moved from its first position toward its second position.

In one embodiment, the platform is rotatable about a first axis and the lever is pivotal about a second axis. The second axis is substantially perpendicular to the first axis. In one implementation, the vehicle body includes a longitudinal axis, and the first axis extends through and is substantially perpendicular to the longitudinal axis.

In one embodiment, the platform is rotatable at least about 180 degrees. The direction in which the vehicle is overturned when the lever moves from the first position to the second position is selectable by rotating the platform.

In another embodiment, the platform is rotatable about a first axis in opposing first and second directions. The platform is linearly movable toward and away from the underside of the vehicle body in opposing third and fourth directions. In one implementation, the platform is linearly movable between a first position spaced from the support surface and a second position in contact with the support surface, the platform causing the vehicle to spin about the first axis when the platform is disposed in its second position.

In one embodiment, the lever is releasably secured to the platform via a latch mechanism when disposed in its first position. In one implementation, the vehicle body includes a chassis and front and rear wheels rotatably coupled to the chassis. The chassis is movable between a raised position and a lowered position via a suspension mechanism, the chassis being biased toward its raised position. The lever is releasably securable to the platform via the latch by moving the chassis to its lowered position.

In one embodiment, the toy vehicle includes a release mechanism coupled to the lever. The release mechanism releasably retains the lever in its first position until actuated. In one implementation, the release mechanism is actuated when the vehicle body has traveled along the support surface a predetermined distance. In another implementation, a safety mechanism is coupled to the release mechanism. The safety mechanism prevents actuation of the release mechanism unless the vehicle body is disposed in its first orientation. In yet another embodiment, the safety mechanism is configured to be actuated only when the vehicle is resting upon a support surface. This may be accomplished by configuring the release mechanism to at least one of the wheels of the toy vehicle.

The present invention also relates to a toy vehicle including a chassis including a front end portion and a rear end portion. Front wheels are rotatably coupled to the front end portion, and rear wheels are rotatably coupled to the rear end portion. A flipping mechanism is movably coupled to the chassis. The flipping mechanism is repositionable between a first position causing the rear end portion to flip upwardly and over the front end portion in a first direction upon actuation, and a second position causing the front end portion to flip upwardly and over the rear end portion in a second direction upon actuation.

In one embodiment, the flipping mechanism is rotatable at least about 180 degrees relative to the chassis. The vehicle is overturnable on a support surface in a selected direction in between the first and second directions.

In one embodiment, the flipping mechanism is rotatable about a first axis. The chassis has a longitudinal axis substantially perpendicular to the first axis. In one embodiment, the flipping mechanism includes a platform rotatably coupled to an underside of the chassis, and a lever pivotally coupled to the platform.

In one embodiment, the flipping mechanism is operable in a first mode and a second mode. In the first mode, the flipping mechanism causes the chassis to be overturned on a support surface upon actuation. In the second mode, the flipping mechanism causes the chassis to spin about an axis substantially perpendicular to the surface.

The present invention is also directed to a toy vehicle including a wheeled vehicle body configured for moving along a support surface when disposed in a first orientation. A spinning mechanism is coupled to an underside of the vehicle body. The spinning mechanism includes an engagement member movable between a first position spaced from the support surface and a second position in contact with the support surface. The engagement member causes the vehicle to spin about an axis when the engagement member is disposed in its second position and the vehicle is disposed in its first orientation.

In one embodiment, the vehicle body includes a longitudinal axis. The axis about which the vehicle spins is substantially perpendicular to the longitudinal axis of the vehicle body.

In one embodiment, the toy vehicle further includes a lever pivotally coupled to the engagement member. The lever is movable between a first position spaced from the support surface and a second position. The lever contacts the support surface as it moves from its first position toward its second position when the vehicle is disposed in its first orientation.

The lever causes the vehicle to be overturned from its first orientation when the lever is moved from its first position toward its second position.

BRIEF DESCRIPTION OF THE DRAWINGS

Like reference numerals have been used to identify like elements throughout this disclosure.

DETAILED DESCRIPTION OF THE INVENTION

Figure 1:
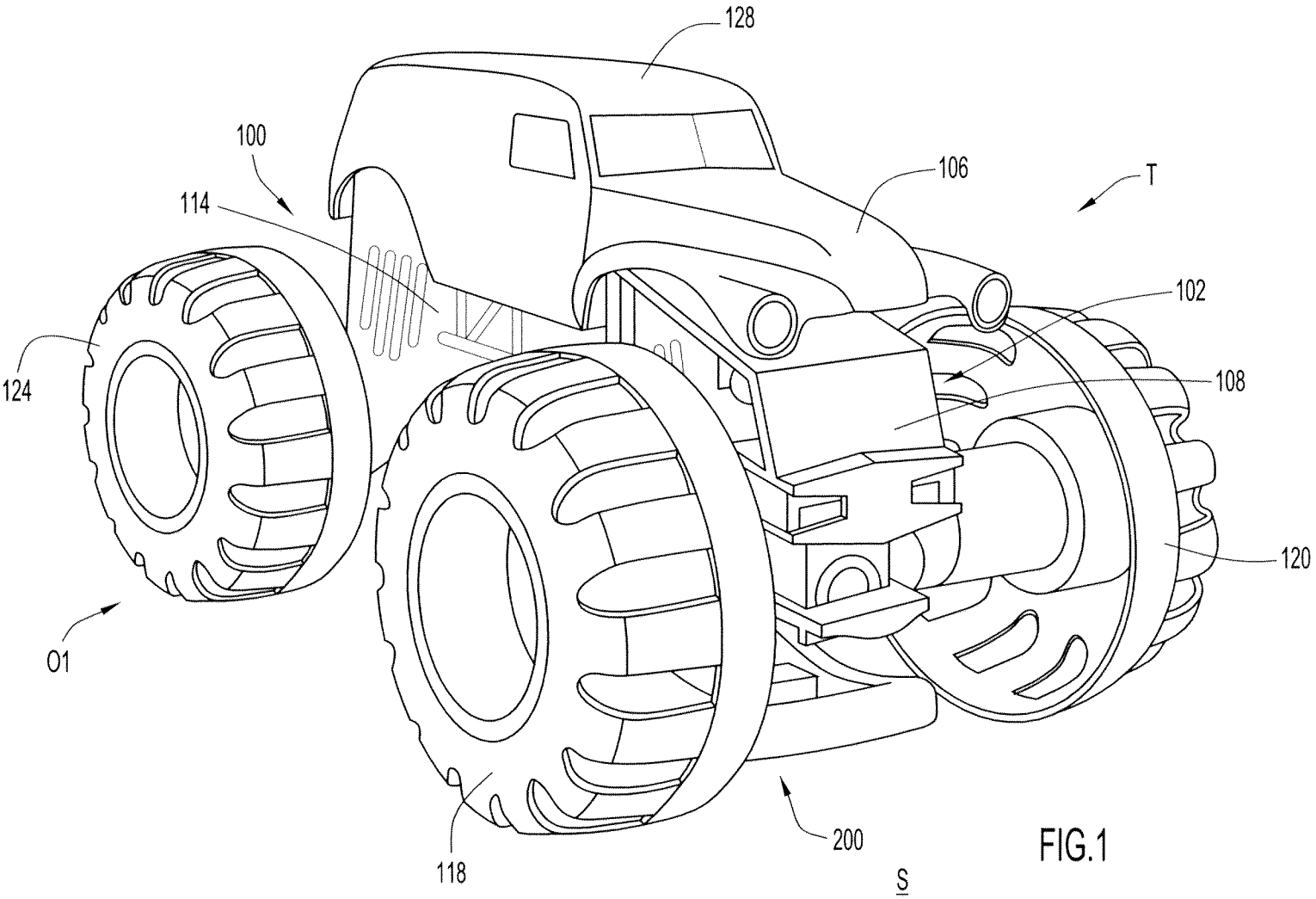
FIG. 1 illustrates a front perspective view of a toy vehicle according to an embodiment of the present invention.
Figure 2:
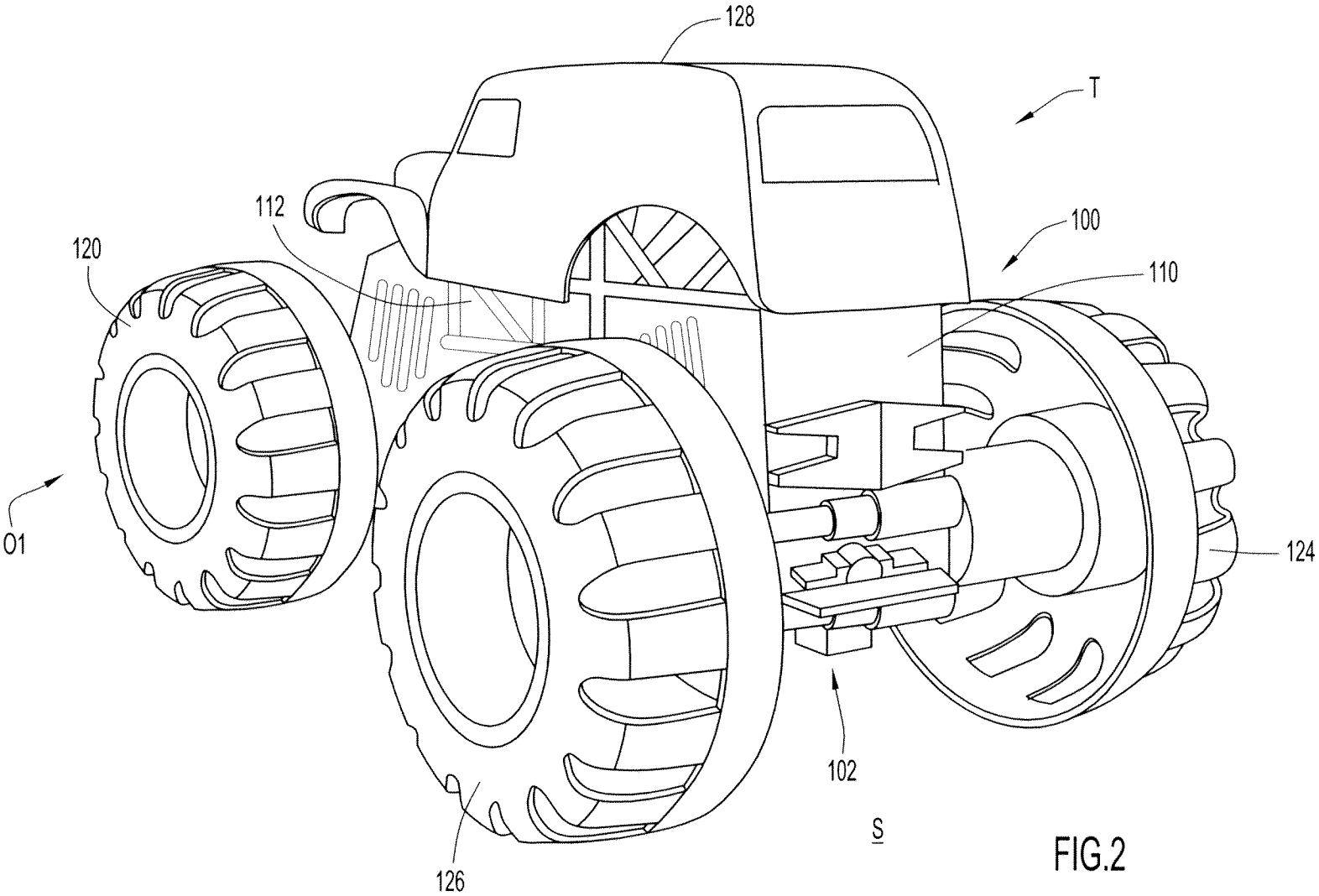
FIG. 2 illustrates a rear perspective view of the toy vehicle of FIG. 1.
Figure 3:
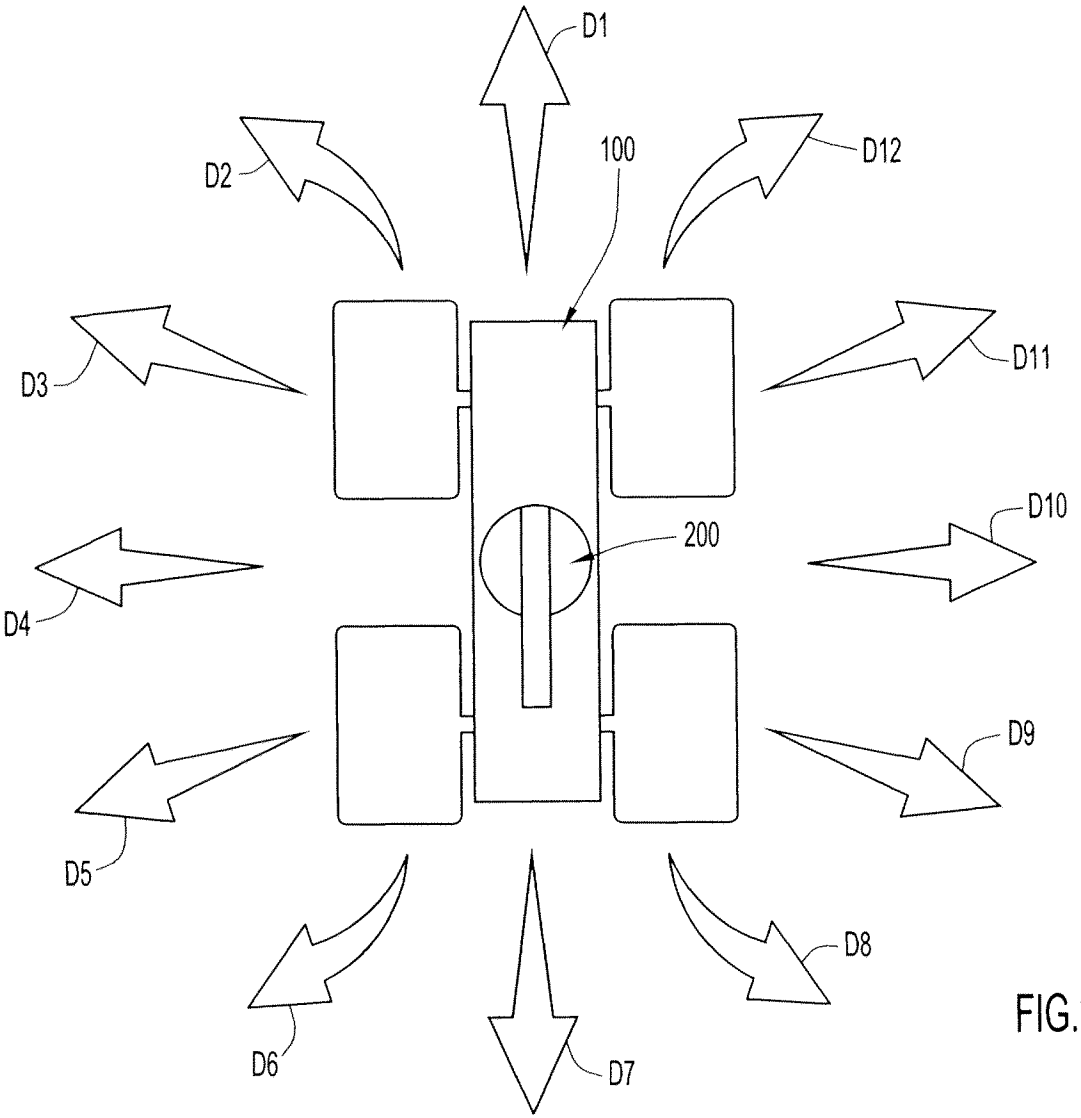
FIG. 3 illustrates a schematic view of a toy vehicle showing directions in which the toy vehicle may be overturned.

An embodiment of a toy vehicle T according to an embodiment of the present invention is illustrated in FIGS. 1 and 2. The toy vehicle T includes a vehicle body 100 and a flipping mechanism 200 movably coupled to the vehicle body 100. The vehicle body 100 is configured for moving along a support surface S when disposed in an upright orientation O1. Referring to FIG. 3, the flipping mechanism 200 is configured for overturning the vehicle body 100 from its upright orientation O1 in a selected direction D1-D12, as described in further detail below. In various embodiments, the quantity of directions can vary.

Figure 4:
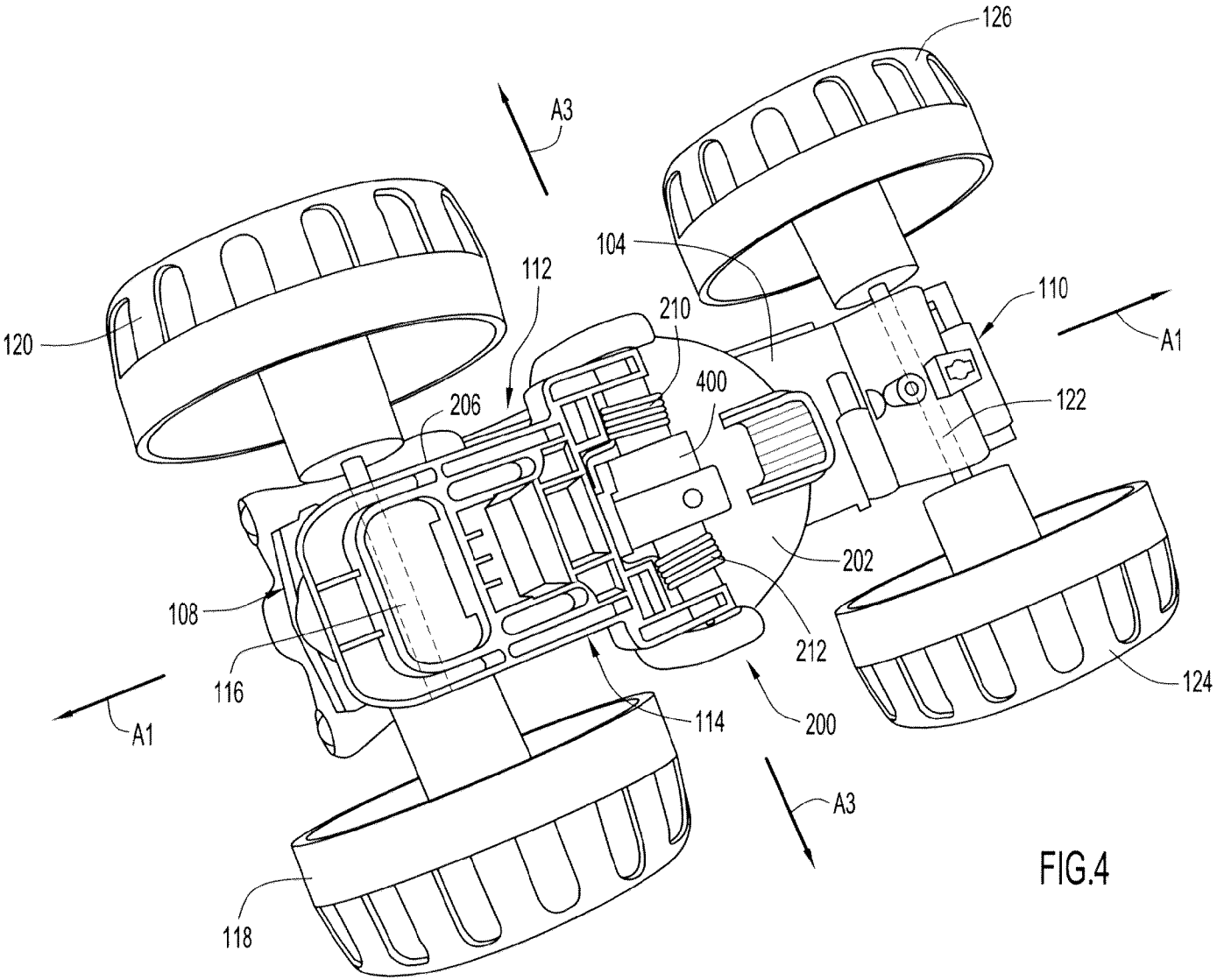
FIG. 4 illustrates a bottom perspective view of the toy vehicle of FIG. 1.

Referring to FIGS. 1, 2 and 4, the vehicle body 100 includes a chassis 102 having an underside 104 and an upper side 106, a front end portion 108 and a rear end portion 110, and left side 112 and a right side 114. The front end portion 108 includes a front axle 116 (shown in phantom in FIG. 4) rotatably mounted thereto with front wheels 118, 120 coupled to the front axle 116. The rear end portion 110 includes a rear axle 122 (shown in phantom in FIG. 4) rotatably coupled thereto with rear wheels 124, 126 coupled to the rear axle 122. The chassis 102 has a longitudinal axis A1 (shown in FIG. 4) extending from the front end portion 108 to the rear end portion 110.

An upper body portion 128 is coupled to the upper side 106 of the chassis 102. As illustrated, the toy vehicle T is configured to resemble a "monster truck" (e.g. a vehicle with oversized wheels and associated suspension). In alternative embodiments, the upper body portion 128 and/or chassis 102 and/or wheels 118, 120, 124, 126 may have a different configuration and/or an alternative theme.

Figure 5:
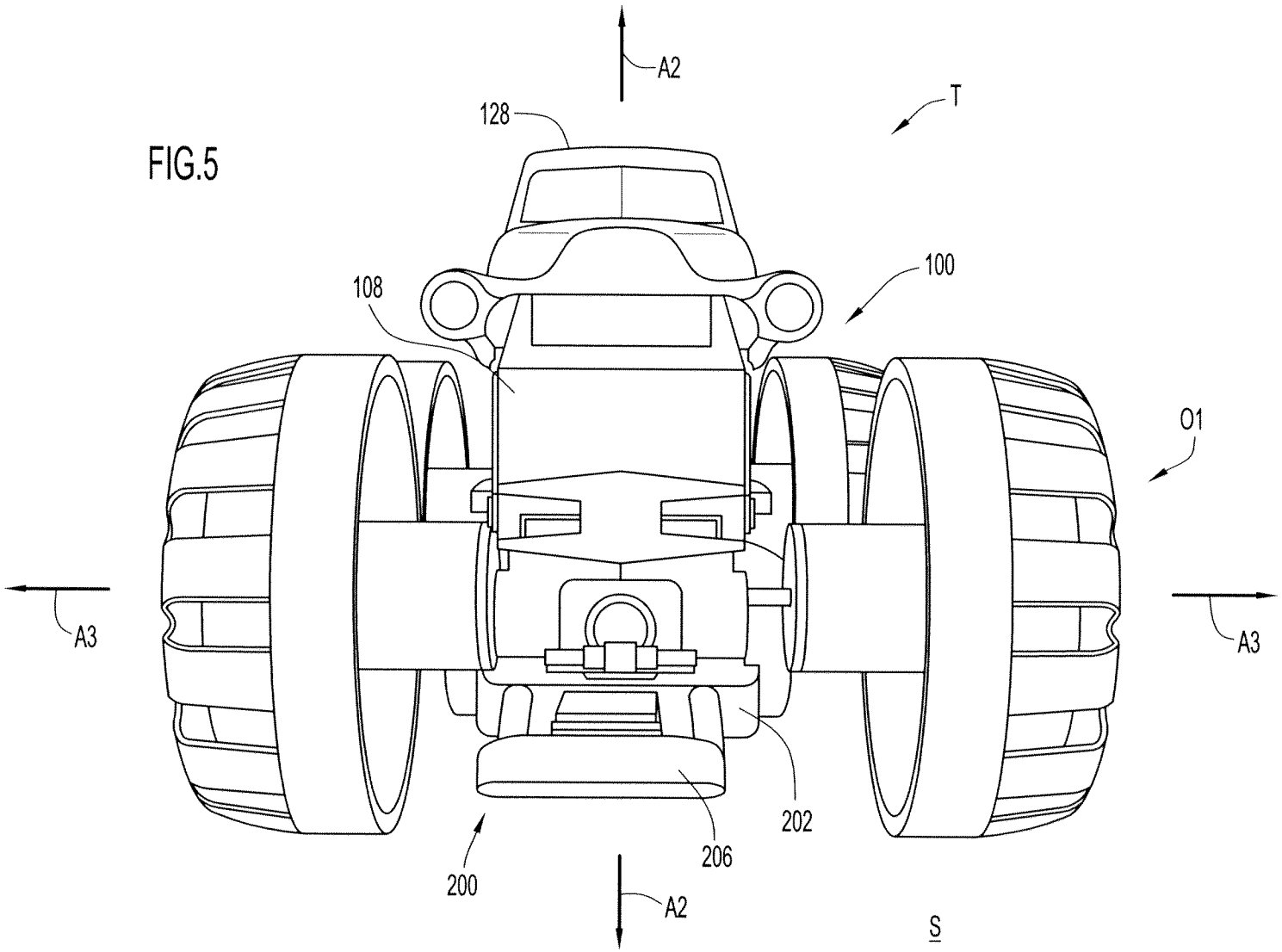
FIG. 5 illustrates a front perspective view of the toy vehicle of FIG. 1.
Figure 6:
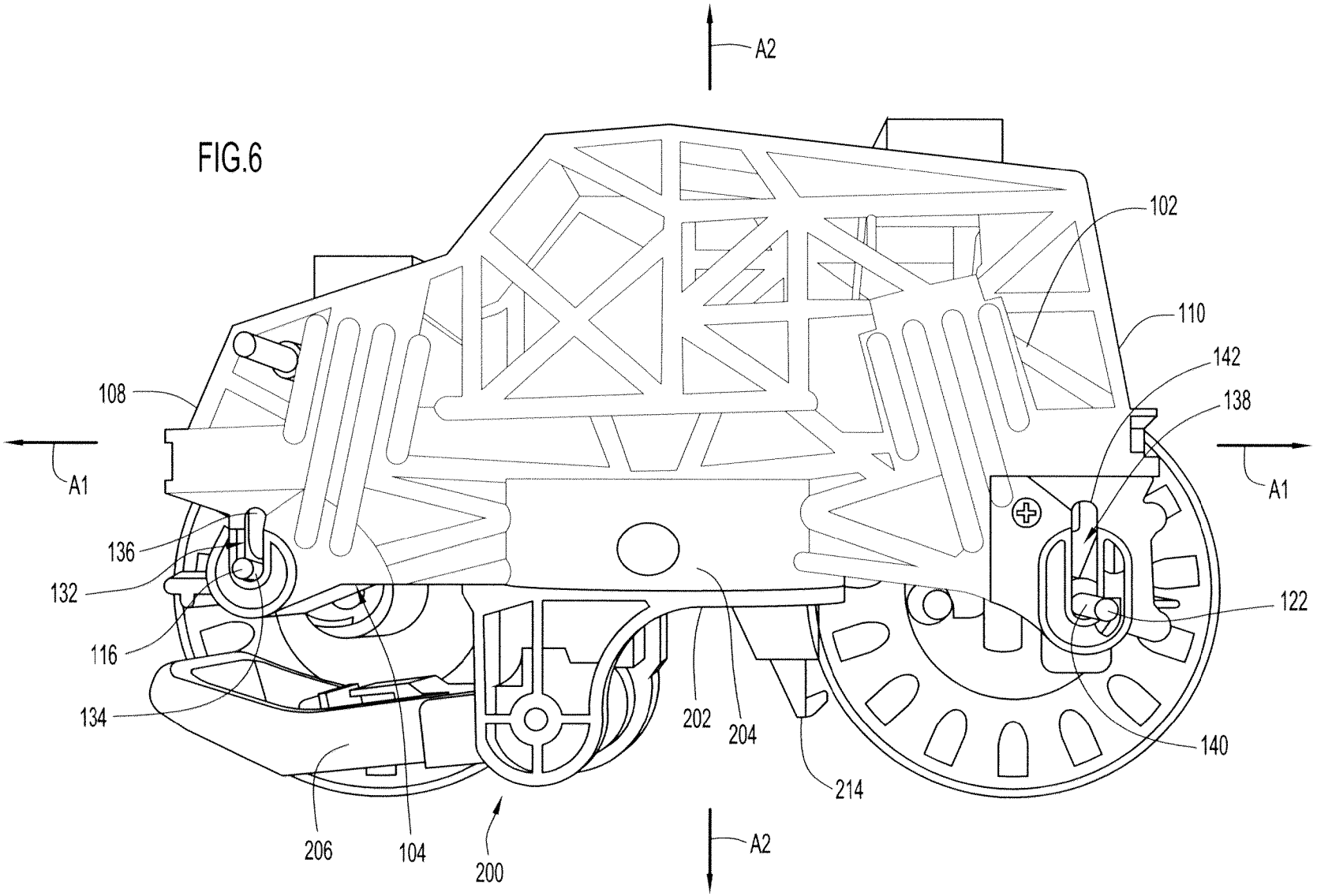
FIG. 6 illustrates a side perspective view of components of the toy vehicle of FIG. 1.

Referring to FIGS. 4, 5 and 6, in one embodiment, the flipping mechanism 200 includes a platform 202 rotatably coupled to the underside 104 of the chassis 102 and in between the front end portion 108 and the rear end portion 110. In one implementation, the platform 202 is rotatably disposed within and coupled to a receiving portion 204 provided in or coupled to the underside 104 of the chassis 102 (as shown in FIG. 6). A lever 206 is pivotally coupled to the platform 202. Thus, the lever 206 is rotatably and pivotally coupled to the chassis 102.

In one implementation, the platform 202 is rotatable about an axis A2 (shown in FIGS. 5 and 6) extending through the toy vehicle T, which is oriented substantially vertically when the toy vehicle T is placed on the support surface S in orientation O1. Referring to FIGS. 4 and 5, the lever 206 is pivotal about another axis A3 that is substantially perpendicular to the axis A2 about which the platform 202 rotates. In orientation O1, axis A3 is substantially horizontal relative to the support surface S. Further, the axis A2 about which the platform 202 rotates is substantially perpendicular to the longitudinal axis A1 of the chassis 102, as shown in FIG. 6.

Figure 7:
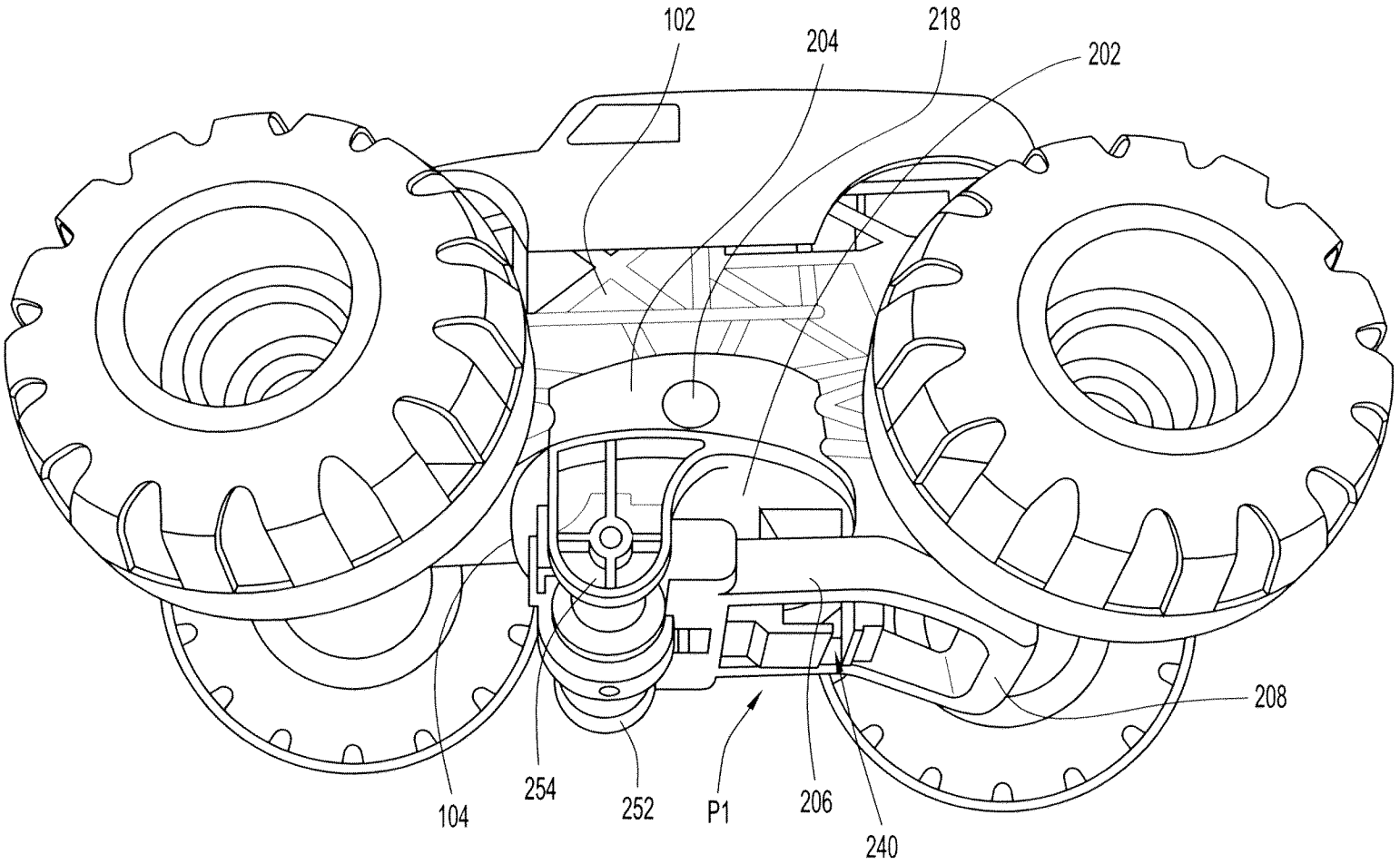
FIG. 7 illustrates another side perspective view of the toy vehicle of FIG. 1, showing a lever of a flipping mechanism in a latched position.
Figure 8:
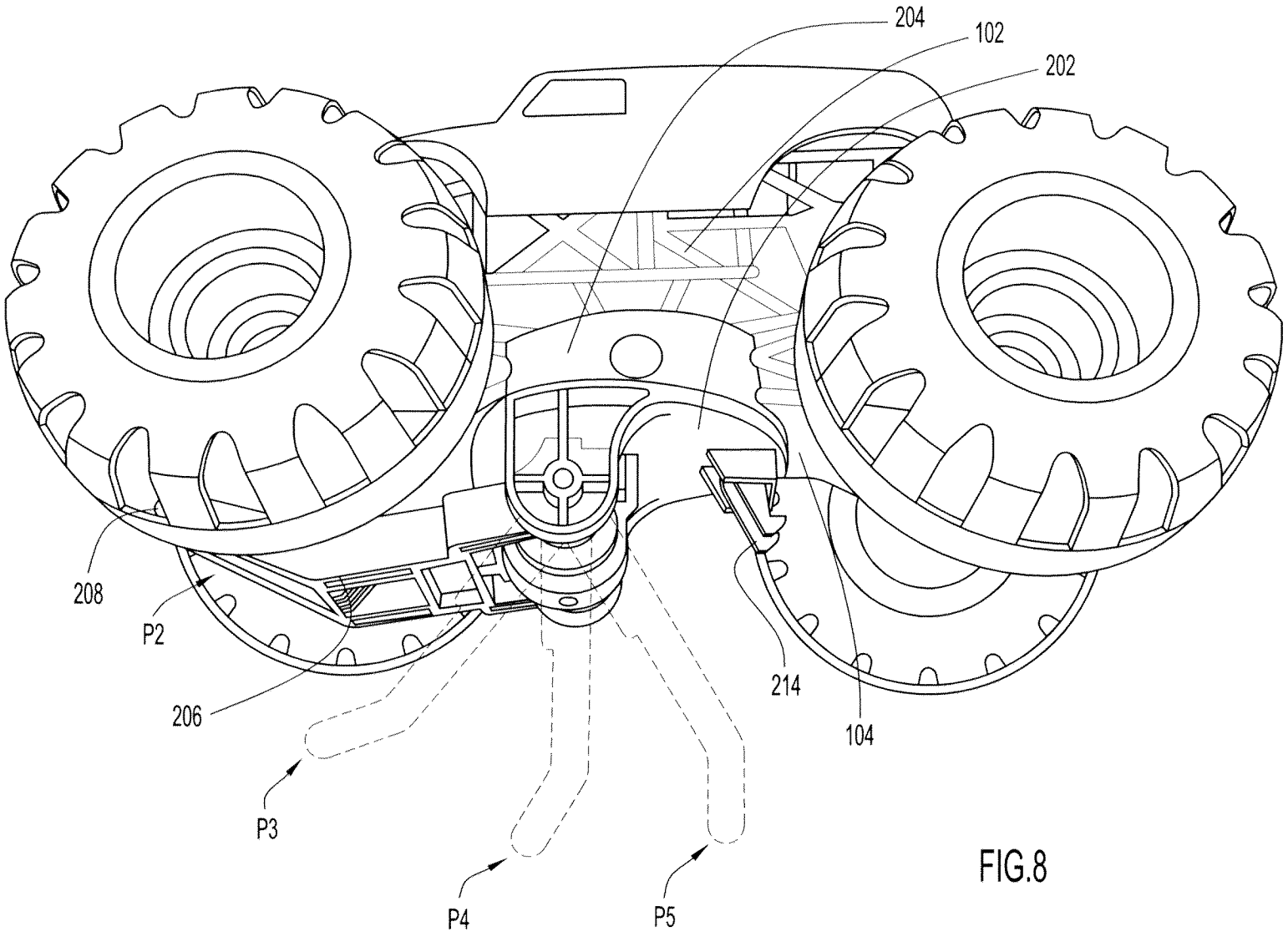
FIG. 8 illustrates another side perspective view of the toy vehicle of FIG. 1, showing the lever of the flipping mechanism in an unlatched position and intermediate positions of the lever in phantom.

Referring to FIGS. 4, 7 and 8, the lever 206 includes a distal end portion 208 movable between a latched position P1 (shown in FIG. 7) proximate to the platform 202 and the underside 104 of the chassis 102, and an unlatched position P2 (shown in FIG. 8) pivoted outwardly from the platform 202 and spaced from the underside 104 of the chassis 102.

The lever 206 is biased toward its unlatched position P2 via one or more resilient members, such as springs 210, 212 (shown in FIG. 4). The springs 210, 212 are under sufficient tension when the lever 206 is in its latched position P1 (shown in FIG. 7), so that when the lever 206 is released, the lever 206 forcibly and rapidly deploys to its unlatched position P2 (shown in FIG. 8). The lever 206 is moved from its latched position P1 to its unlatched position P2 upon actuation of the flipping mechanism 200. The lever 206 may be releasably retained in its latched position P1 via a catch 214 (see FIG. 6), which is triggered upon actuation of the flipping mechanism 200 (described in further detail below). The lever 206 is configured to cause the toy vehicle T to be overturned or flip from its upright orientation O1 when the lever 206 is rapidly moved from its latched position P1 to its unlatched position P2 and the lever 206 contacts the support surface S or other structure.

With continued reference to FIGS. 7 and 8, when the toy vehicle T is disposed on the support surface S in its upright orientation O1 (see FIG. 1), the distal end portion 208 of the lever 206 is spaced apart from the support surface S when in its latched position P1, and in contact with the support surface S as it moves toward its unlatched position P2. When the lever 206 moves from its latched position P1 toward its unlatched position P2, the contact of the distal end portion 208 of the lever 206 on the support surface S causes the toy vehicle T to flip or overturn from its upright orientation O1. Because the platform 202 is rotatable about axis A2 (e.g. in a clockwise direction and/or a counterclockwise direction), the position of the lever 206 relative to the front end portion 108 and rear end portion 110 of the toy vehicle T may be adjusted and selected. As a result, the direction (e.g. direction D1-D12, shown in FIG. 3) in which the vehicle T will be overturned or flipped upon actuation of the flipping mechanism 200 is selectable.

Thus, the lever 206 may be selectively positioned by rotating the platform 202 about axis A2 so that the distal end portion 208 of the lever 206 pivots outwardly in a particular direction. In one implementation, the platform 202 is rotatable about axis A2 at least about 180 degrees. In another implementation, the platform 202 is rotatable 360 degrees about axis A2 and relative to the chassis 102. The platform 202 may be releasably retained in a selected position about its rotational axis A2 via a detent 216 (shown in FIG. 13) which cooperates with a correspondingly configured recessed area 218 provided in the receiving portion 204 of the chassis 102. Alternatively, the platform 202 may be releasably retained in a selected position about its rotational axis A2 via another latching or positioning mechanism. The quantity of detents or recessed areas can vary in different embodiments.

Figure 9:
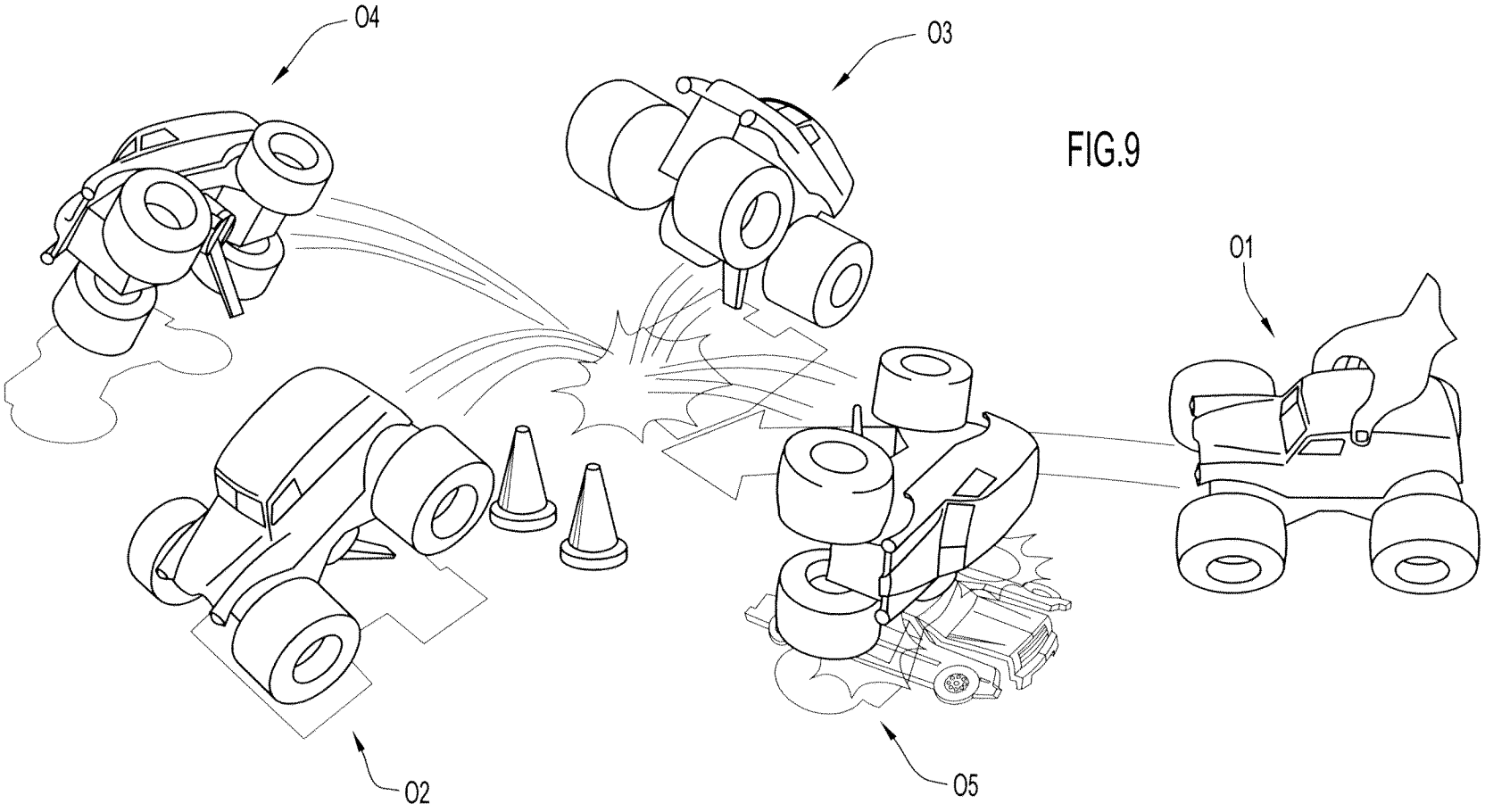
FIG. 9 illustrates a stylized perspective view of the toy vehicle of FIG. 1, showing various orientations in which the toy vehicle is overturnable.

Referring to FIGS. 3 and 9, the direction in which the toy vehicle T will be overturned from its upright orientation O1 corresponds to the selected direction (e.g. direction D1-D12 as shown in FIG. 3) in which the lever 206 pivots as it moves from its latched position P1 toward its unlatched position P2. For example, the platform 202 may be rotated so that the lever 206 will pivot outwardly in direction D1. Pivotal movement of the distal end portion 208 of the lever 206 in direction D1 toward the front end portion 108 of the chassis 102 causes the rear end portion 110 to be lifted upwardly and thrust forward in direction D1, so that the toy vehicle T is flipped or overturned in a forward direction D1 (shown as orientation O2 in FIG. 9). Alternatively, the platform 202 may be rotated so that the lever 206 will pivot outwardly in direction D7. Pivotal movement of the distal end portion 208 of the lever 206 in direction D7 toward the rear end portion 110 of the chassis 102 causes the front end portion 108 to be lifted upwardly and thrust backward in direction D7, so that the toy vehicle T is flipped or overturned in a backward direction D7 (shown as orientation O3 in FIG. 9).

Similarly, pivotal movement of the distal end portion 208 of the lever 206 in direction D4 toward the right side 114 of the chassis 102 causes the left side 112 to be lifted upwardly so that the toy vehicle T is flipped or overturned in direction D4 (shown as orientation O4 in FIG. 9). Pivotal movement of the distal end portion 208 of the lever 206 in direction D10 toward the left side 112 of the chassis causes the right side 114 to be lifted upwardly so that the toy vehicle T is flipped or overturned in direction D10 (shown as orientation O5 in FIG. 9). The toy vehicle T may be selectively flipped in other intermediate directions (e.g. directions D2, D3, D5, D6, D8, D9, D11, D12, shown in FIG. 3) by rotating the platform 202 about axis A2, thereby orienting the lever 206 in a selected position. Thus, the toy vehicle T may be overturned or flipped toward a selected one of the directions D1-D12.

Referring to FIGS. 7 and 8, several positions of the lever 206 are illustrated. The lever 206 is loaded and retained in its latched position P1 (see FIG. 7) and moves to its unlatched position P2 (see FIG. 8) when it is released. Several intermediate loading positions P3, P4, and P5 are illustrated in phantom in FIG. 8 and are described in greater detail below.

Once the flipping lever 206 has been flipped or moved to its unlatched position P2, the child must reload the lever 206 by moving the lever 206 from its unlatched position P2 back to its latched position P1. The movement of the lever 206 from position P2 to position P1 requires a certain amount of force to overcome the force of the springs 210 and 212 (shown in FIG. 4). Typically, a child may find it difficult to move the flipping lever 206 from position P2 to position P1 using the child's hands alone. A child may be able to move the lever 206 from position P2 to intermediate position, P5, in which the lever 206 is slightly past vertical relative to the pin about which the lever 206 pivots. The additional force needed to further move the lever 206 can be applied by a child after the child places the vehicle T on the support surface S and presses downward on the upper vehicle body 128. When the vehicle T is placed on the support surface S, the lever 206 engages the support surface S and is moved or pivoted toward its latched position P1 due to its contact with the support surface S.

The vehicle T includes a pair of suspension mechanisms, such as springs which are described below, which bias the chassis 102 upwardly relative to the front and rear axles of the toy vehicle T. In this embodiment, one of the suspension springs is located in the front of the vehicle T and the other of the suspension springs is located in the rear of the vehicle T. Accordingly, when the toy vehicle T is on the support surface S, the chassis 102 can be moved downward toward support surface S, thereby compressing the springs and moving the chassis 102 closer to the front and rear axles. The result of such movement is that the chassis 102 can be moved closer to the support surface S to facilitate further pivoting of the lever 206.

If the chassis of the toy vehicle T is fixed so that it does not move relative to the front and rear axles, then the movement of the lever 206 relative to the chassis is limited to a point that is even with the points of contact between the wheels and the support surface S. As a result, the lever 206 will slide along and contact the support surface S as the vehicle T travels along the support surface S.

Returning to this embodiment, the movement of the chassis 102 relative to the front and rear axles and the wheels allows the chassis 102 to be moved closer to the support surface S than its resting position, which results in the flipping lever 206 being moved by the support surface S to a point closer to the chassis 102 than the contact points of the wheels on the support surface S. As a result, once latched, the lever 206 is raised above and does not contact the support surface S when the toy vehicle T moves therealong. When a child removes the force applied to the vehicle body, the springs bias the chassis 102 upward and the toy vehicle T can be used on the support surface S, without lever 206 rubbing on the support surface S.

Figure 10:
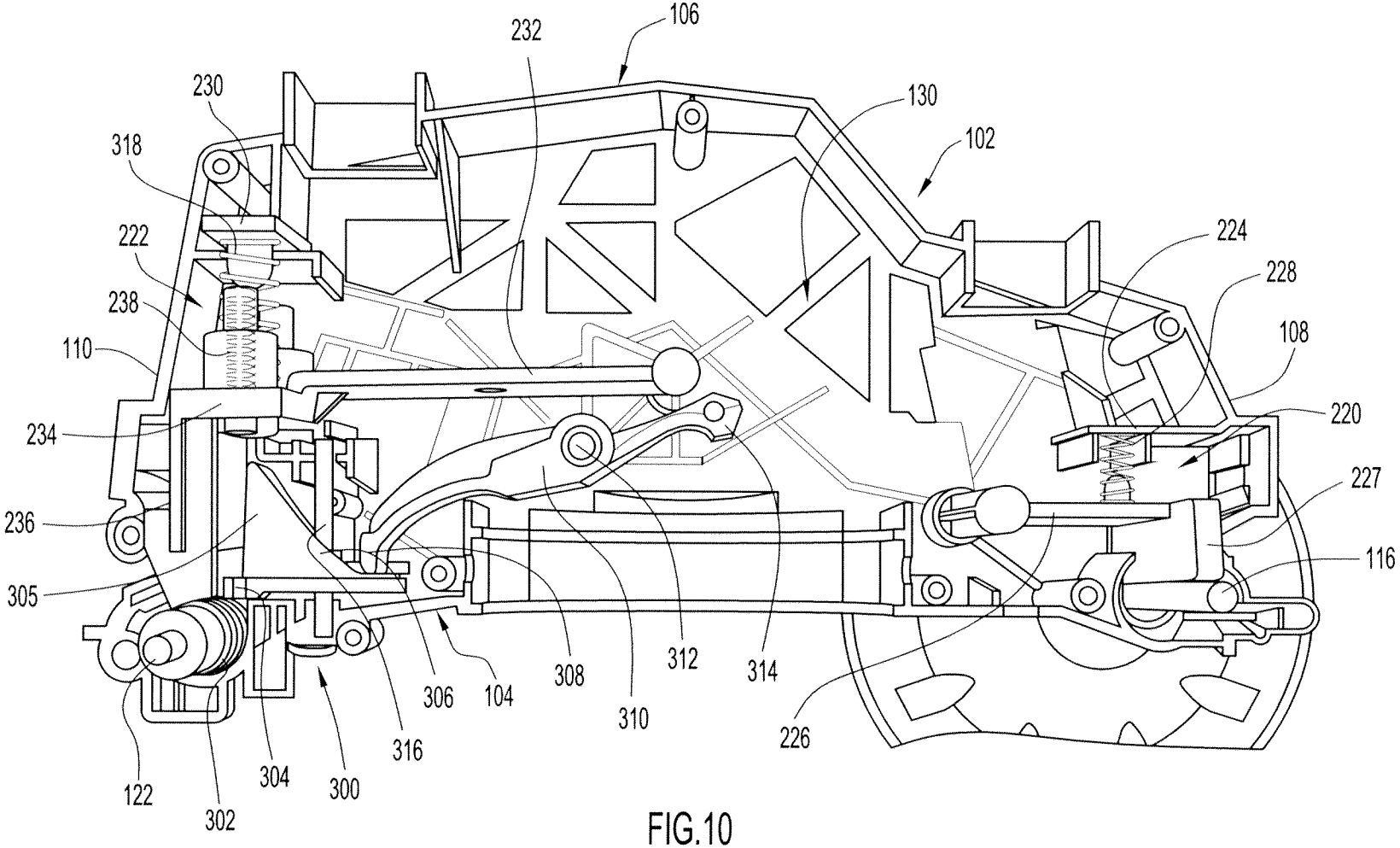
FIG. 10 illustrates a sectional perspective view of components within a chassis of the toy vehicle of FIG. 1.

Referring to FIG. 10, part of the vehicle body is removed so that the internal components can be viewed. As shown, in this embodiment, the front end portion 108 of the chassis 102 is coupled to the front axle 116 via a front suspension mechanism 220. In addition, the rear end portion 110 of the chassis 102 is coupled to the rear axle 122 via a rear suspension mechanism 222. The chassis 102 is movable toward and away from the support surface S via the front and rear suspension mechanisms 220, 222, such as when a child pushes downwardly on the upper body portion 128 while the front and rear wheels 118, 120, 124, and 126 are resting on the support surface S.

With continued reference to FIG. 10, the front suspension mechanism 220 includes a front plate 224 coupled to and disposed within an interior cavity 130 defined by the chassis 102, and a front suspension arm 226 pivotally coupled to and disposed within the interior cavity 130. The front suspension arm 226 includes a distal end portion 227 in contact with the front axle 116. Referring to FIG. 6, the front axle 116 is disposed within a slot 132 defined by the front end portion 108 of the chassis 102. The front axle 116 is movable between a lower end 134 and an upper end 136 of the slot 132.

Referring again to FIG. 10, a resilient member, such as a spring 228, is coupled to and extends between the front plate 224 and the front suspension arm 226. The front suspension arm 226 and front plate 224 are thereby tensionably spaced from each other. The distal end portion 227 is biased against the front axle 116 via the spring 228, so that the front axle 116 is biased toward the lower end 134 of the slot 132 and the chassis 102 is biased upwardly. The chassis 102 may be moved downwardly toward the support surface S by applying a downward force on the upper body portion 128 (e.g. when the child pushes downwardly on the toy vehicle T), thereby compressing the spring 228. Upon release of the downward force, the chassis 102 is biased upwardly via the spring 228. Thus, the front end portion 108 of the chassis 102 is biased upwardly and away from the support surface S, but permitted to move downwardly a predetermined distance (e.g. substantially equal to or less than the length of the slot 132) toward the support surface S, such as when downward pressure is exerted on the chassis 102 and/or the front wheels 118, 120 encounter a bump or other obstacle. As discussed above, such movement of the chassis 102 assists a child with the reloading of the flipping lever 206 to its latched position P1.

With continued reference to FIGS. 6 and 10, the rear suspension mechanism 222 includes a rear plate 230 coupled to and disposed within the interior cavity 130, and a rear suspension arm 232 pivotally coupled to and disposed within the interior cavity 130. The rear suspension arm 232 includes a distal end portion 234. An engagement plate 236 extends downwardly toward and is in contact with the rear axle 122. Referring to FIG. 6, the rear axle 122 is disposed within a slot 138 defined by the rear end portion 110 of the chassis 102. The rear axle 122 is movable between a lower end 140 and an upper end 142 of the slot 138.

Referring again to FIG. 10, a resilient member, such as another spring 238 (shown in phantom), is coupled to and extends between the rear plate 230 and the distal end portion 234 of the rear suspension arm 232. The rear suspension arm 232 and rear plate 230 are thus also tensionably spaced from each other. The engagement plate 236 is biased against the rear axle 122 via the spring 238, so that the rear axle 122 is biased toward the lower end 140 of the slot 138. The chassis 102 may be moved downwardly toward the support surface S by applying a downward force on the upper body portion 128 (e.g. when the child pushes downwardly on the toy vehicle T), thereby compressing the spring 238. Upon release of the downward force, the chassis 102 is biased upwardly via the spring 238. Thus, the rear end portion 110 of the chassis 102 is biased upwardly and away from the support surface S, but permitted to move downwardly a predetermined distance (e.g. substantially equal to or less than the length of the slot 138) toward the support surface S, such as when downwardly pressure is exerted on the chassis 102. As described above, such movement of the chassis 102 assists a child with the reloading of the flipping lever 206. Furthermore, said movement may enable activation of the safety mechanism disclosed above.

Referring again to FIGS. 7 and 8, the lever 206 may be moved to and releasably secured in its latched position P1 (shown in FIG. 7) via the catch 214 (shown in FIG. 8) by first manually pivoting the lever 206 at least past vertical where the lever 206 is held by a ratchet mechanism (as described below in FIGS. 16 and 18) and then applying a downward force on the upper body portion 128 and/or on the chassis 102. The lever 206 may be moved from its unlatched position P2, through intermediate positions P3, P4, P5 (shown in FIG. 8), and to its latched position P1 (shown in FIG. 7) by manually pivoting the lever 206. The movement of the chassis 102 and upper body portion 128 relative to the axles and the support surface S makes it easier for a child to move the flipping lever 206 to its latched position P1 and for the lever 206 to be moved to and retained in a raised position out of contact with the support surface S.

In one embodiment, the lever 206 is releasably retained in position P3, position P4 and/or position P5 once pivoted thereto via a ratcheting mechanism 400 (shown in FIGS. 4, 16 and 17, and described in further detail below). With continued reference to FIGS. 7 and 8, as described above, once the lever 206 is pivoted to and retained in position P5, the toy vehicle T may be placed on the support surface S so that the distal end portion 208 of the lever 206 contacts the support surface S. The upper body portion 128 and/or the chassis 102 is then depressed by the user toward the support surface S. The chassis 102 is permitted to move downwardly toward the support surface S as the front and rear axles 116, 122 move from the lower ends 134, 140 toward the upper ends 136, 142 of the slots 132, 138, respectively. As the underside 104 of the chassis 102 moves toward the support surface S, the lever 206 contacts the support surface S and is pushed from its position P5 to its latched position P1 (shown in FIG. 7). The catch 214 engages and is releasably secured within a correspondingly configured opening 240 provided in the lever 206. The lever 206 is thereby releasably retained in its latched position P1 via the catch 214.

With continued reference to FIGS. 6 and 10, a release mechanism 300 for actuating the flipping mechanism 200 is disposed within the cavity 130 of the chassis 102. In one embodiment (see FIG. 11), the release mechanism 300 includes a worm screw 302 coupled to and rotatable with the rear axle 122, and a plate 303 with a body 305 and a sector gear 304 integrally formed thereon (see FIG. 10A). The sector gear 304 includes several teeth 307 that extend around a portion of the perimeter of a lower end of plate 303 coupled to the body 305. The body 305 also includes a ramp 306, which engages an end 308 of an arm 310. The arm 310 is pivotally mounted about a post 312, so that as its end 308 is moved upwardly and away from the underside 104 of the chassis 102, an opposing end 314 of the arm 310 is moved downwardly and toward the underside 104 of the chassis 102.

Figure 11:
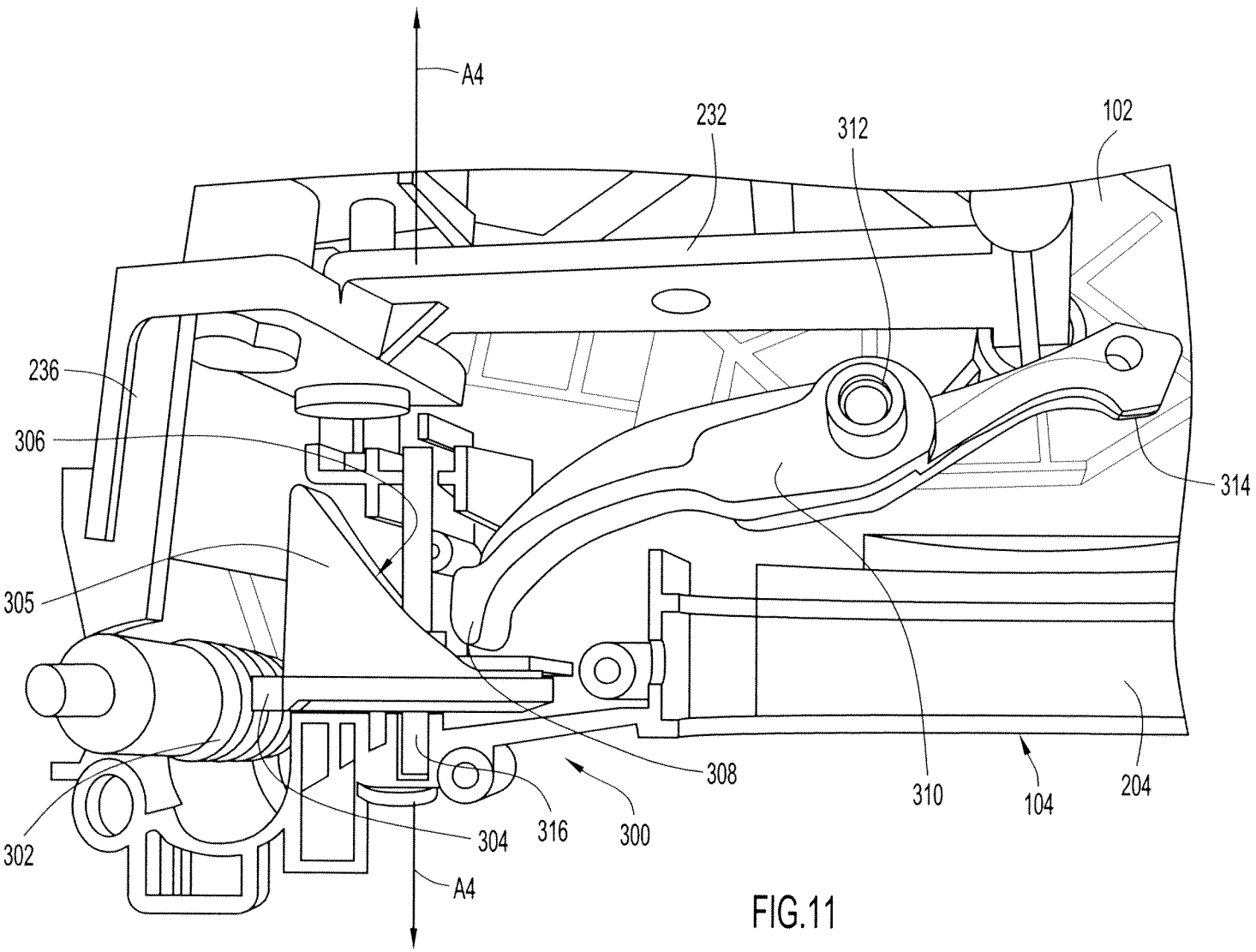
FIG. 11 illustrates an exploded perspective view of some of the components shown in FIG. 10, showing components of a release mechanism in a first orientation.

Referring to FIGS. 10 and 11, when the toy vehicle T is placed on the support surface S, the weight of the chassis 102 partially compresses the springs 228, 238 of the front and rear suspension mechanisms 220, 222, respectively, so that the front and rear axles 116, 122 slide upwardly in their respective slots 132, 138 in FIG. 6. As a result, the worm gear 302 is moved upwardly and into engagement with the sector gear 304. As the rear axle 122 is rotated (e.g., as the toy vehicle T rolls along the support surface S), the worm gear 302 engages and rotates the sector gear 304 and its associated axle 316 about an axis A4. When the sector gear 304 has rotated a predetermined amount, such as when the vehicle T has traveled a predetermined distance along the support surface S, the body 305 has rotated sufficiently so that ramp 306 engages the end 308 of the arm 310, thereby pushing the end 308 upwardly and away from the underside 104 of the chassis 102.

Figure 12:
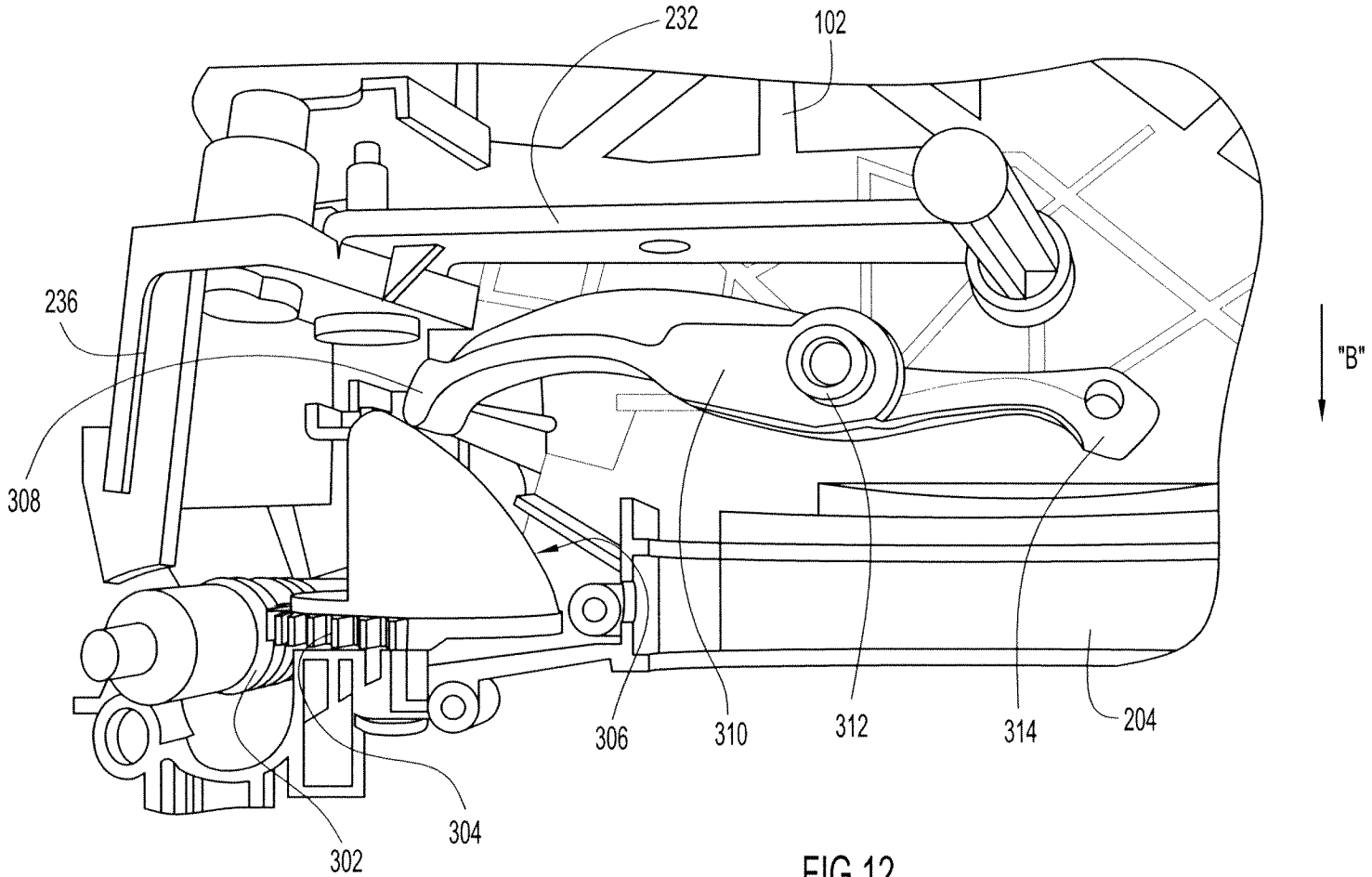
FIG. 12 an exploded perspective view of the components shown in FIG. 11, showing components of the release mechanism in another orientation.

As shown in FIG. 12, the opposing end 314 of the arm 310 is thereby moved downwardly toward the receiving portion 204 on the underside 104 of the chassis 102. The opposing end 314 contacts a trigger 262 (shown in FIG. 13 and described in further detail below) on the flipping mechanism 200, which releases the catch 214 and thus the lever 206 from its latched position P1. The lever 206 then rapidly moves from its latched position P1 toward its unlatched position P2, as described above. The toy vehicle T is thereby overturned in the selected direction corresponding to the position of the lever 206 about axis A2 (see FIG. 5).

Referring again to FIG. 10, when the toy vehicle T is moved so that the wheels 118, 120, 124, and 126 of the vehicle T are no longer contacting the support surface S, the weight of the chassis 102 no longer compresses the springs 228, 238 of the front and rear suspension mechanisms 220, 222, respectively. As a result, the front and rear axles 116, 122 slide downwardly in their respective slots 132, 138 due to the weight of the wheels 118, 120, 124, and 126. In addition, the spring 238 decompresses and pushes the distal end portion 234 of the rear suspension arm 232 and thus the engagement plate 236 against the rear axle 122. As the rear axle 122 drops downwardly in its slot, the worm gear 302 disengages from the sector gear 304 (see FIGS. 10 and 12) and the sector gear 304 can no longer be rotated when it is spaced apart from the worm gear 302, even if the rear axle 122 is rotated (e.g., when a child spins the rear wheels 124, 126).

Figure 10A:
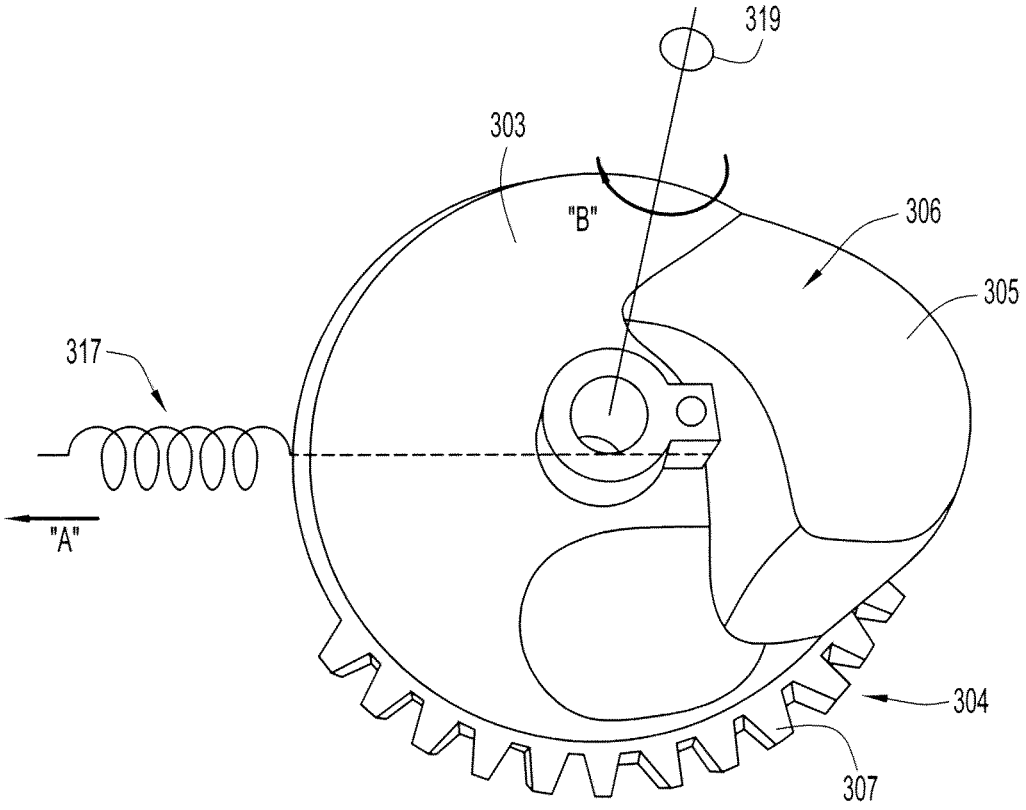
FIG. 10A illustrates a perspective view of an embodiment of a sector gear of the toy vehicle of FIG. 1.

Referring to FIG. 10A, the sector gear 304 is biased by a spring 317 along the direction of arrow "A" so that it rotates about axis 319 defined by axle 316 (see FIG. 10 or 11) along the direction of arrow "B" back to its starting or initial position. The spring 317 can be directly coupled to the sector gear 304 or coupled via a connector, such as a pin. This initial position of the sector gear 304 is where the teeth 307 of the sector gear 304 are in mesh with the teeth on the worm gear 302. In this position, the teeth 307 have to travel the length of the teeth on the worm gear 302 as sector gear 304 pivots about axis 319 to reach its released position in which the teeth do not engage each other, thereby activating the release mechanism and allowing the flipping lever 206 to pivot. As long as the teeth of the gears are engaged, rotation back of the sector gear 304 is prevented.

Each time that the toy vehicle T is lifted off the support surface S, the rear axle 122 drops downwardly in its slot and the teeth of the worm gear 302 disengage from the teeth 307 of the sector gear 304. When the different sets of the teeth are not engaged, the sector gear 304 is free to pivot about axle 316 and axis 319. Accordingly, the spring 317 causes the freed sector gear 304 to pivot as described above and return to its initial position. The result is that the triggering mechanism of toy vehicle T is automatically reset whenever the worm gear 302 disengages the sector gear 306. Thus, whenever the vehicle T is lifted, the trigger mechanism is disconnected as a safety feature so the flipping lever 206 cannot be activated. To be activated again, the toy vehicle T must be placed on the support surface S and travel the full length of the teeth 307 of the sector gear 304 before the release mechanism is activated to release the lever 206 to flip. Accordingly, actuation of the flipping mechanism 200 is prevented unless the vehicle T is disposed in its upright orientation O1 and the vehicle T has traveled the length engagement of the teeth of the worm gear 302 and the sector gear 304.

In one implementation, a safety spring 318 is coupled to and intermediate the distal end portion 234 of the rear suspension arm 232 and the rear plate 230. The safety spring 318 may be disposed around the spring 238 of the rear suspension mechanism 222 as spring 318 has a larger diameter. The engagement plate 236 is biased downwardly and the spring 238 of the toy vehicle is lifted off the ground. However, if the toy vehicle T is then turned upside down (relative to the support surface S), the weight of at least one of the wheels 118, 120, 124, and 126 and/or the front axle 116, or rear axle 122 then acts to move the worm gear 302 back into engagement with the sector gear 304. The tensioning force of the spring 318 overcomes the forces created by the weight of the wheels 118, 120, 124, and 126 and/or axles 116, 122, again biasing the rear axle 122 and worm gear 302 away from the sector gear 304. Thus, even if the toy vehicle T is resting or held upside down, the worm gear 302 remains disengaged from the sector gear 304. In this way, actuation of the flipping mechanism 200 is prevented unless the vehicle T is disposed in its upright orientation O1 with its weight resting on the support surface S.

In its upright orientation O1, the weight of the upper body portion 128 and/or chassis 102 compresses the spring 238, so that the worm gear 302 is moved upwardly and into engagement with the sector gear 304. The release mechanism 300 may again be triggered by rotation of the rear axle 122 (and accordingly, the worm screw 302 and the sector gear 304). In addition, spring 318 allows for the compression or movement of the lever 206 beneath the body of the toy vehicle T. When a child presses down on the toy vehicle T when the vehicle T is in orientation O1, the force applied by the child compresses the spring 318 so that the chassis of the toy vehicle T can move proximate to the support surface if lever 206 is past vertical, then it further compresses to force the lever 206 into its locked position. As the lever 206 moves to its latched position P1, it is horizontal, as the lever 206 moves past horizontal, the lever 206 is pivoted and the spring 318 is compressed. When released by a child, the spring 318 pushes the upper body portion 128 upward.

Figure 13:
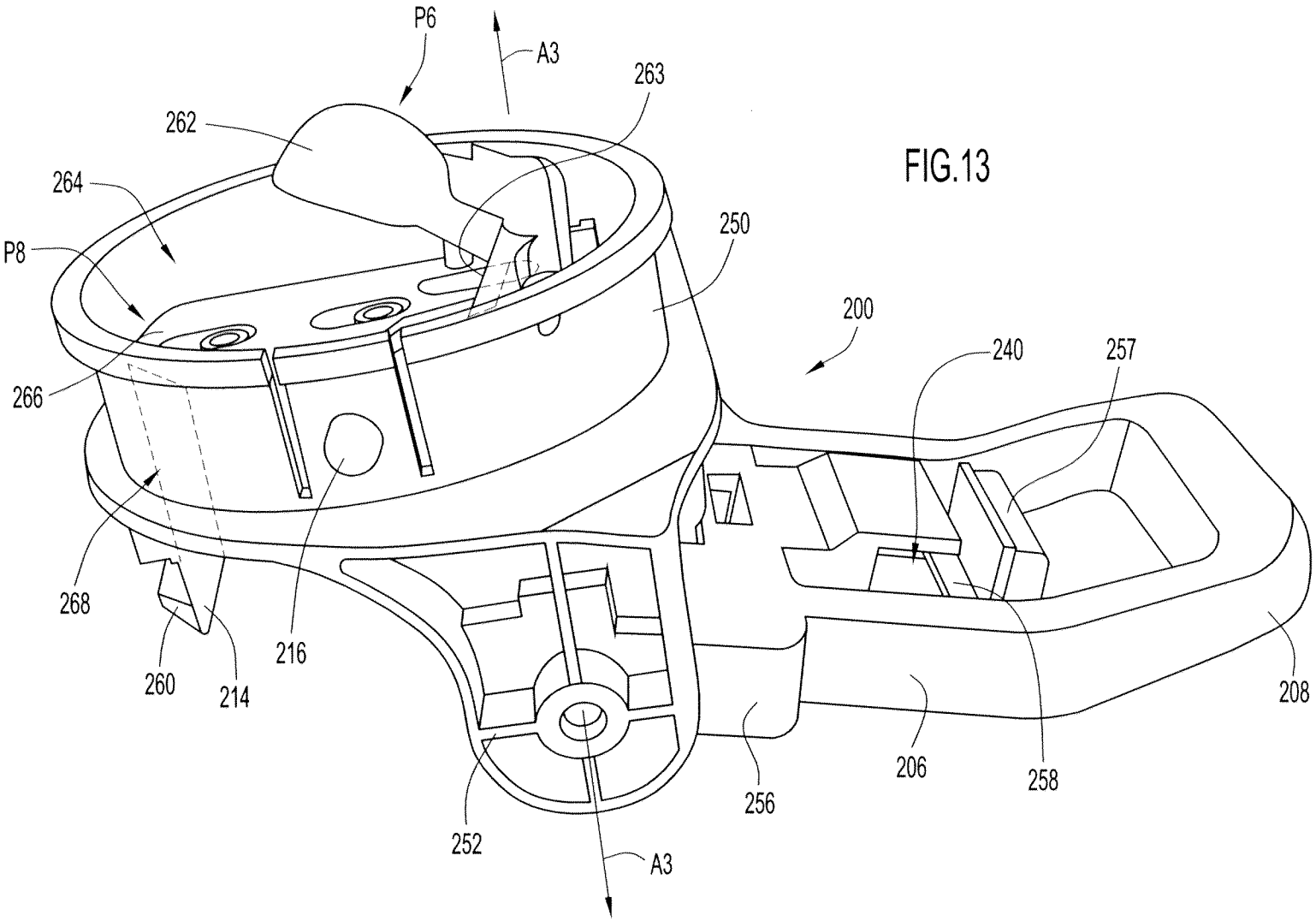
FIG. 13 illustrates a side perspective view of a flipping mechanism of the toy vehicle of FIG. 1.

Referring to FIG. 13, the flipping mechanism 200 includes an upper portion 250 rotatably disposed within the receiving portion 204 (shown in FIGS. 11 and 12) of the chassis 102. Spaced brackets 252, 254 (shown in FIG. 7) extend downwardly from the upper portion 250. With continued reference to FIG. 13, an end portion 256 of the lever 206 is pivotally coupled to and disposed between the brackets 252, 254. The lever 206 is pivotal about its rotational axis A3, as described above. The lever 206 includes a bar 257 with a ledge 258 adjacent the opening 240, on which a correspondingly configured lip 260 of the catch 214 is retained.

Figure 14:
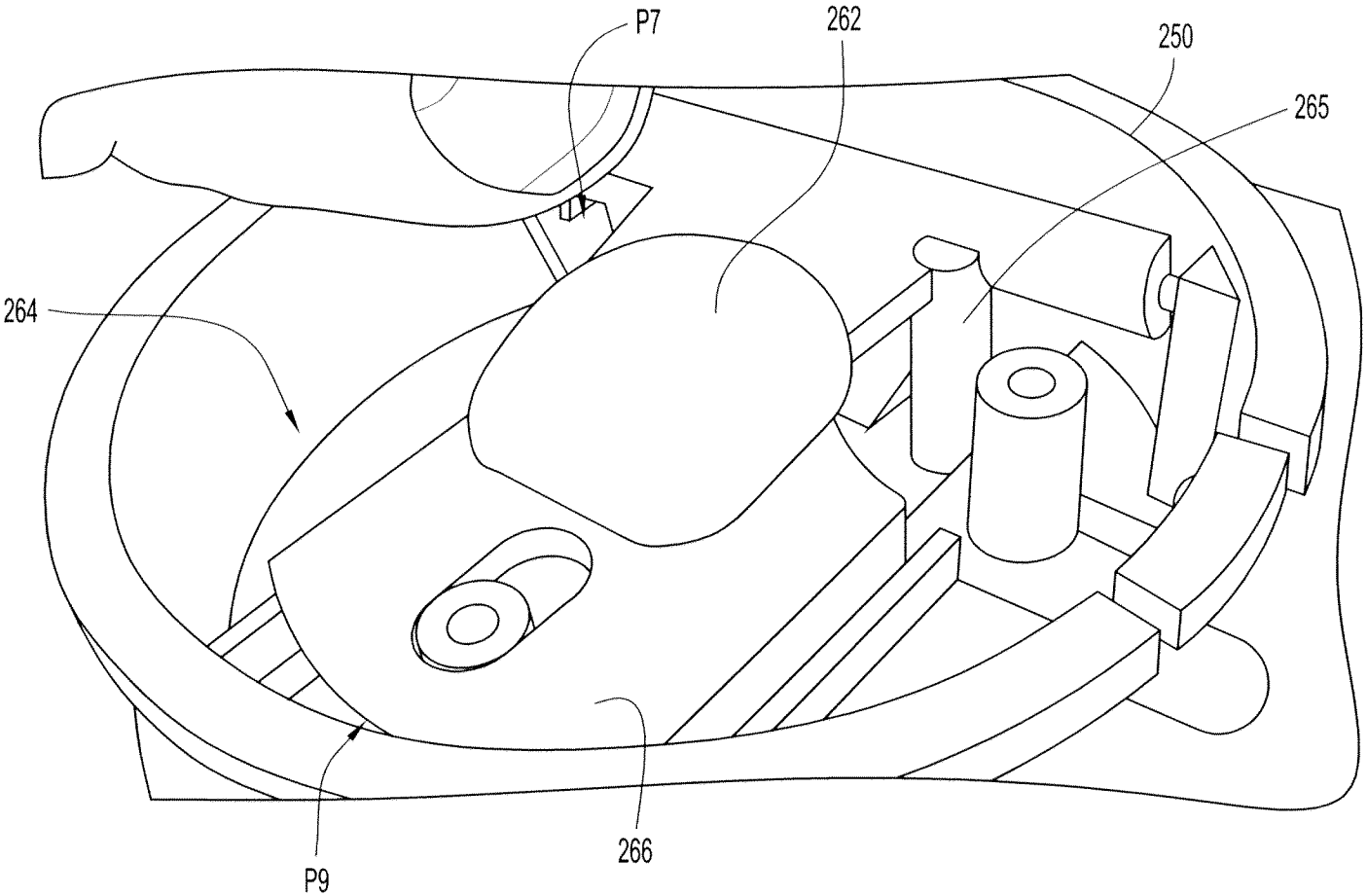
FIG. 14 illustrates a top perspective view of components of the flipping mechanism of FIG. 13, showing a trigger in a lowered position.

Referring to FIGS. 13 and 14, the upper portion 250 defines a compartment 264 in which the trigger 262 is movably disposed. A projection 263 (shown in phantom in FIG. 13) is coupled to or integrally formed with the trigger 262. A slide plate 266 is also disposed in the compartment 264, and includes an extension portion 268 (shown in phantom in FIG. 13) coupled to or integrally formed with the catch 214.

Figure 15:
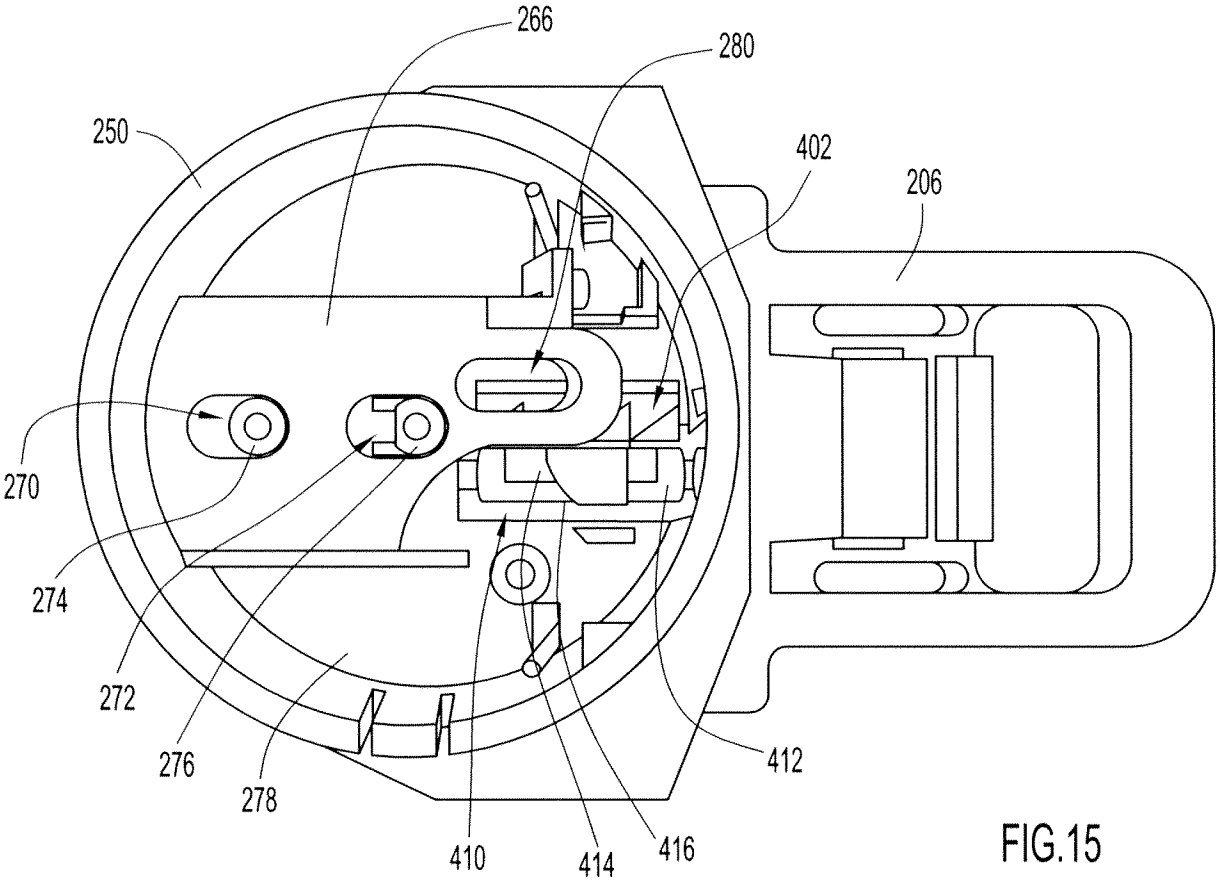
FIG. 15 illustrates a top perspective view of components of the flipping mechanism of FIG. 13.

Referring to FIG. 15, which is a top view, the slide plate 266 defines slots 270, 272 in which posts 274, 276 are slidably received, respectively. The posts 274, 276 are connected to and extend upwardly from a base 278 of the upper portion 250. The slide plate 266 defines another slot 280 in which the projection 263 (shown in phantom in FIG. 13) is received.

Referring again to FIGS. 13 and 14, the trigger 262 is movable between a raised position P6 (shown in FIG. 13) and a lowered position P7 (shown in FIG. 14). When the trigger 262 is disposed in its raised position P6, the slide plate 266 is biased toward a de-actuated position P8 (shown in FIG. 13) via an associated resilient member, such as a spring (not shown). As the trigger 262 is moved from its raised position P6 to its lowered position P7, the projection 263 of the trigger 262 is moved along the slot 280 and contacts an end of the slot 280. The slide plate 266 is then moved or slid to an actuated position P9 (shown in FIG. 14) as the trigger 262 moves to its fully lowered position P7.

As the slide plate 266 moves from its de-actuated position P8 to its actuated position P9, the lip 260 of the catch 214 is moved away from the ledge 258 of the lever 206. Thus, the lever 206 is rapidly deployed from its latched position P1 to its unlatched position P2 via the springs 210, 212 as shown in FIGS. 4 and 16.

The trigger 262 is moved from its raised position P6 to its lowered position P7 by the arm 310 of the release mechanism 300. When the worm gear 302 is engaged with the sector gear 304, and the rear axle 12 rotates, the sector gear 304 rotates about axis A4, as shown in FIG. 11. After the sector gear 304 has rotated a predetermined amount, the ramp 306 engages the end 308 of the arm 310, pushing the end 308 upwardly as described above. As shown in FIG. 12, the opposing end 314 of the arm 310 is moved downwardly along the direction of arrow "B" and toward the receiving portion 204. The end 314 of the arm 310 is pushed against the trigger 262, causing the trigger 262 to move from its raised position P6 (shown in FIG. 13) to its lowered position P7 (shown in FIG. 14), thereby actuating the flipping mechanism 200.

Figure 16:
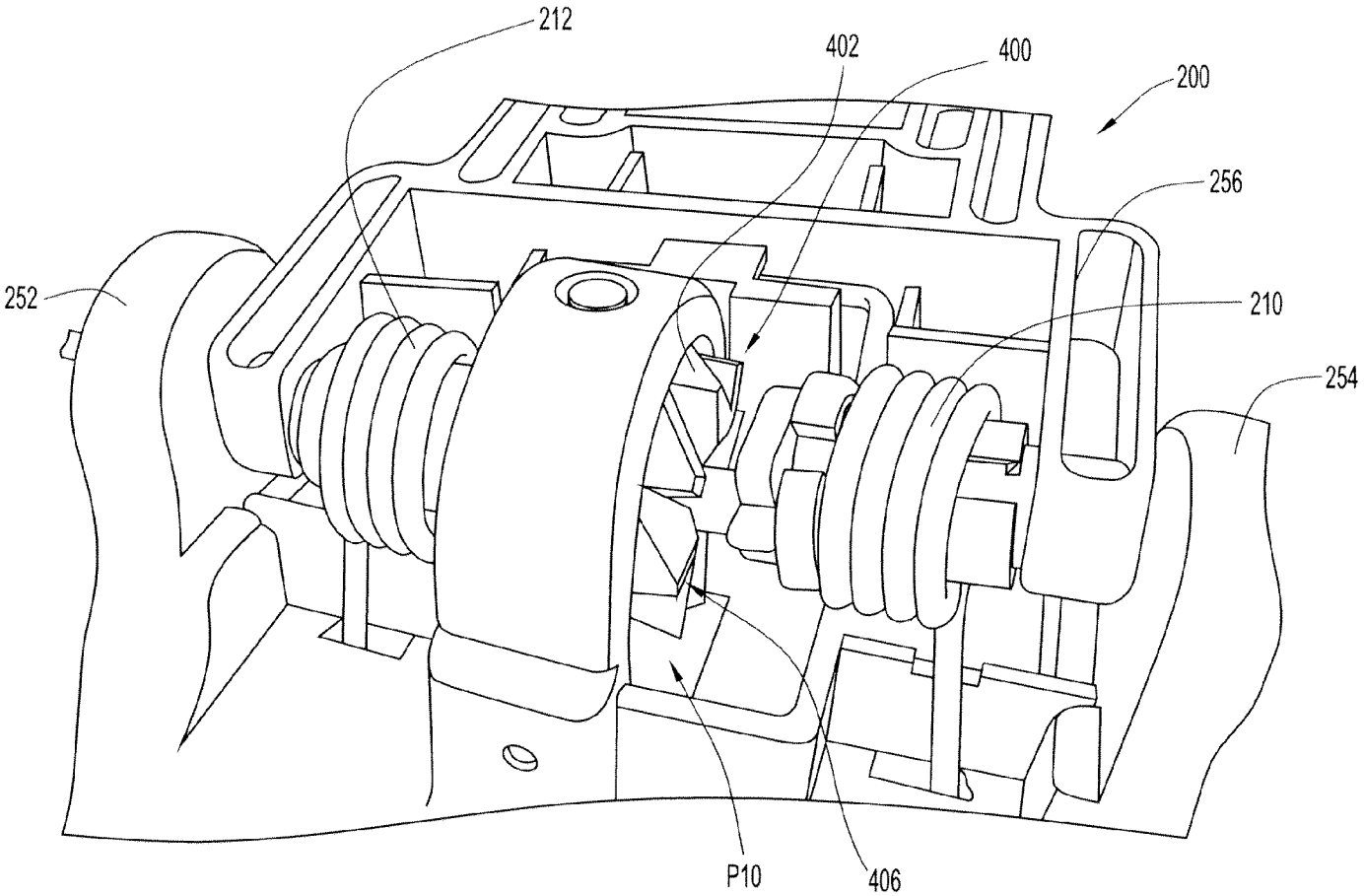
FIG. 16 illustrates a bottom perspective view of components of the flipping mechanism of FIG. 13, showing a member of a ratcheting mechanism in an extended position.
Figure 17:
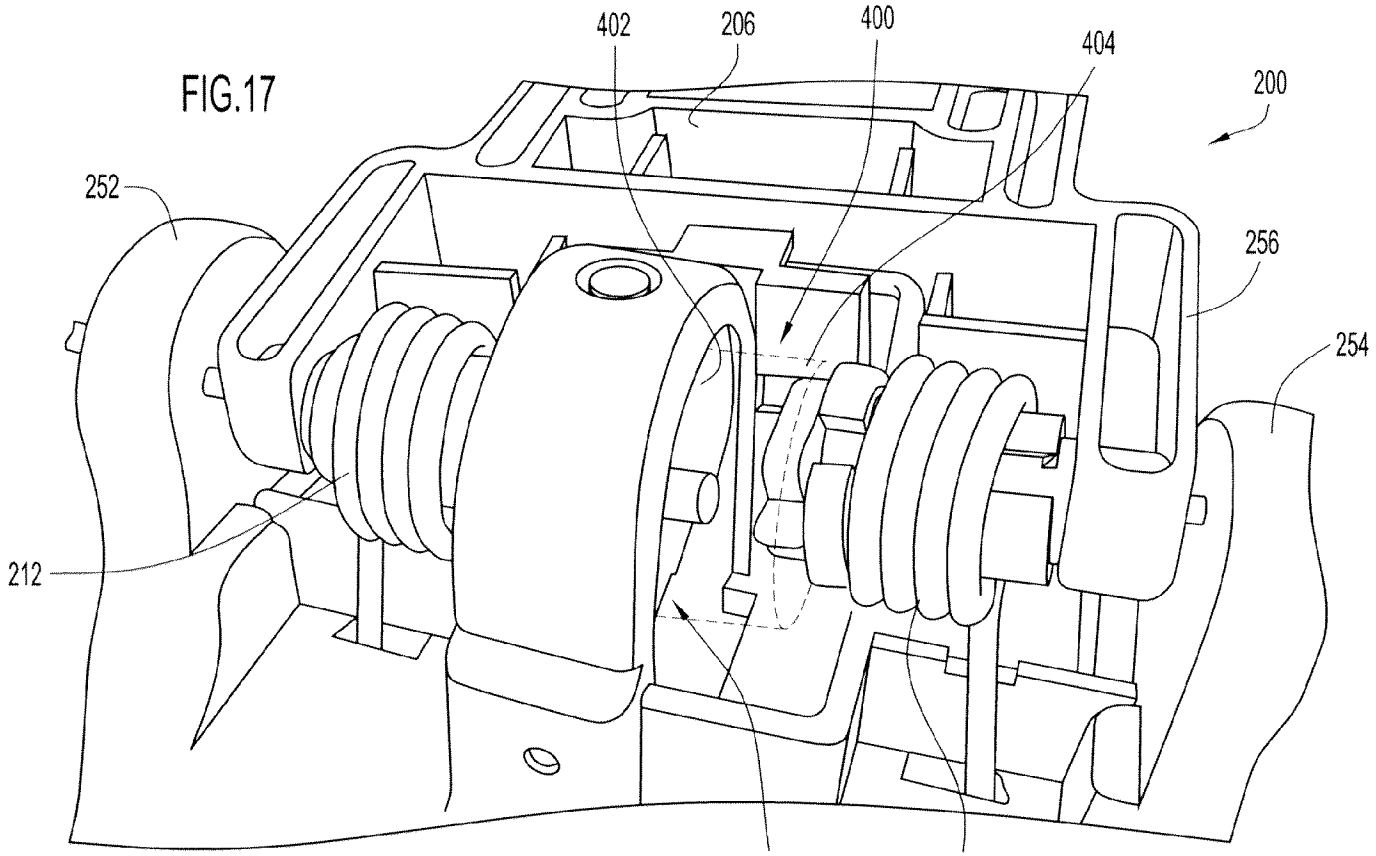
FIG. 17 illustrates another bottom perspective view of components of the flipping mechanism of FIG. 16, showing the member of the ratcheting mechanism in a retracted position.

Referring to FIGS. 16 and 17, the flipping mechanism 200 may include the ratcheting mechanism 400, as noted above. The ratcheting mechanism 400 is coupled to the end portion 256 of the lever 206, and in between brackets 252, 254. The ratcheting mechanism 400 includes a first member 402 and a second member 404 (shown in phantom in FIG. 17). The first member 402 is rotatably fixed relative to the rotational axis A3 (shown in FIGS. 4 and 13) of the lever 206, but axially movable between an extended position P10 (shown in FIG. 16) and a retracted position P11 (shown in FIG. 17).

Figure 17A:
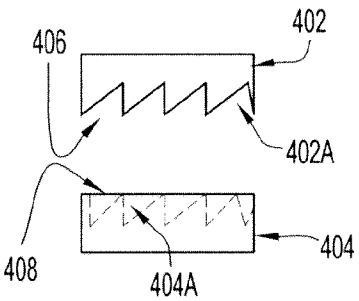
FIG. 17A illustrates an exploded side view of some components of the ratcheting mechanism.
Figure 18:
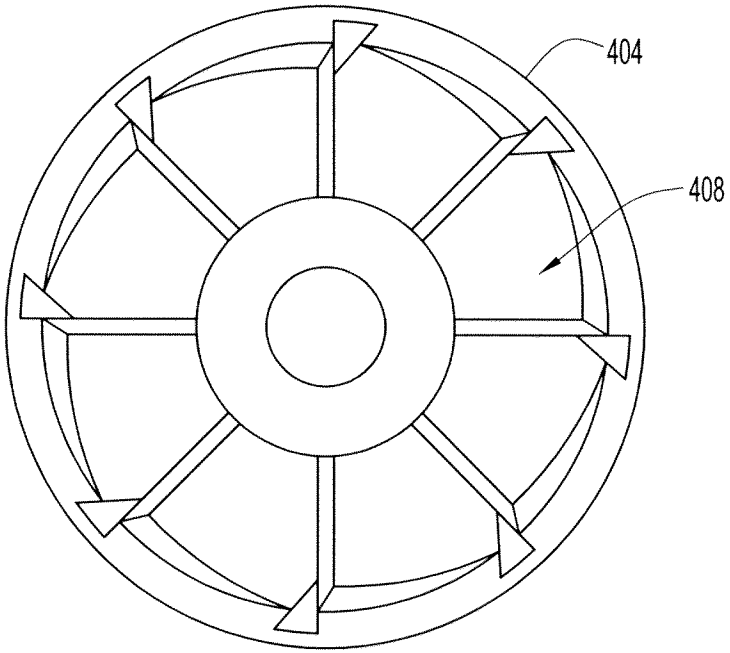
FIG. 18 illustrates a top view of another member of the ratcheting mechanism of FIG. 16.

The first member 402 includes a ridged face 406, as best shown in FIGS. 16 and 17A. The ridged face 406 includes several teeth 402A. Referring to FIGS. 17A and 18, the second member 404 includes a correspondingly configured recessed or ridged face 408 with several recesses 404A formed therein. The teeth 402A of the ridged face 406 of the first member 402 engage the recesses 404A formed in face 408 of the second member 404 when the first member 402 is in its extended position P10. The first member 402 is disengaged from the second member 404 when the first member 402 is in its retracted position P11. When the first and second members 402, 404 are engaged, the lever 206 is permitted to rotate in increments in a single rotational direction (e.g. clockwise or counterclockwise depending on the orientation of the user and the flipping mechanism 200), but restricted from rotating in the opposite direction due to the angular orientation of the cooperating ridged faces 406, 408. As the first member 402 is rotatably fixed relative to the rotational axis A3 of the lever 206, the lever 206 is held against the tensioning force of the springs 210, 212 by the engaged members 402, 404 (e.g. such as in positions P3, P4 and P5, shown in FIG. 8).

When the first member 402 is moved from its extended position P10 to its retracted position P11, the first and second members 402, 404 are no longer in engagement. Thus, the lever 206 is permitted to snap back toward its unlatched position P2 due to the biasing force of the springs 210, 212.

Referring again to FIG. 15, the base 278 of the upper portion 250 includes an opening 410. A movement member 412 is pivotally disposed in the opening 410. The movement member 412 includes an end or arms (not shown) which contacts the first member 402 of the ratcheting mechanism 400. The movement member 412 also includes an opposing end 414. A cam surface 416 is coupled to or defined by the opposing end 414.

Figure 15A:
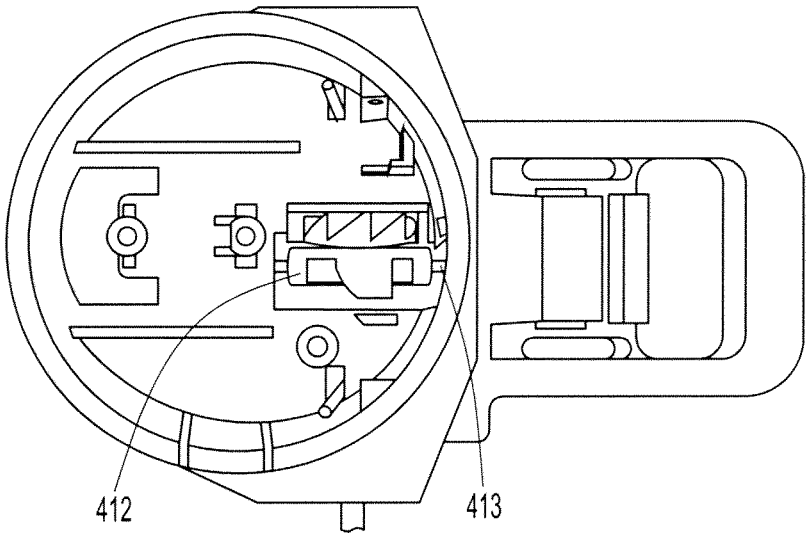
FIGS. 15A and 15B are bottom and top views, respectively, of components of the flipping mechanism of FIG. 13 in first positions.
Figure 15B:
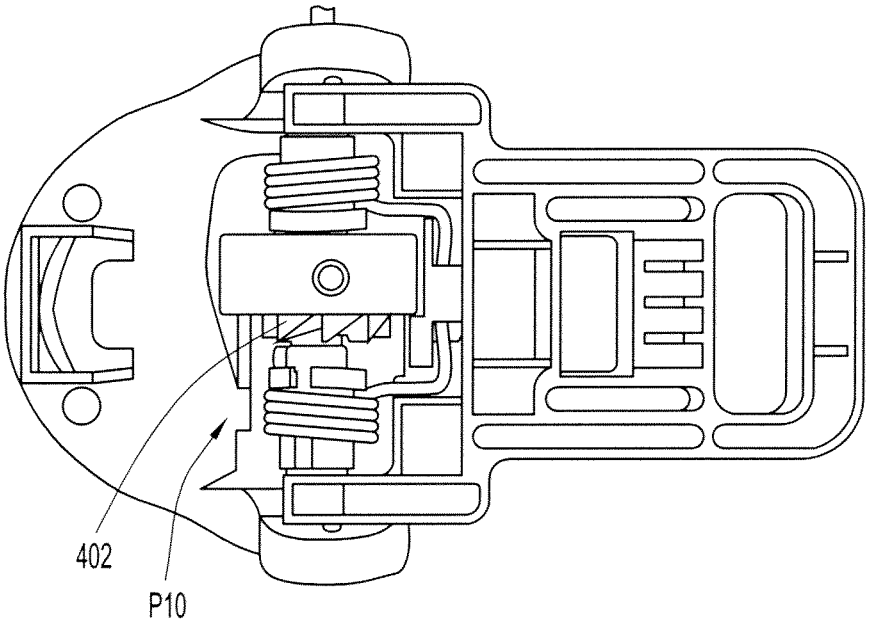
Figure 15C:
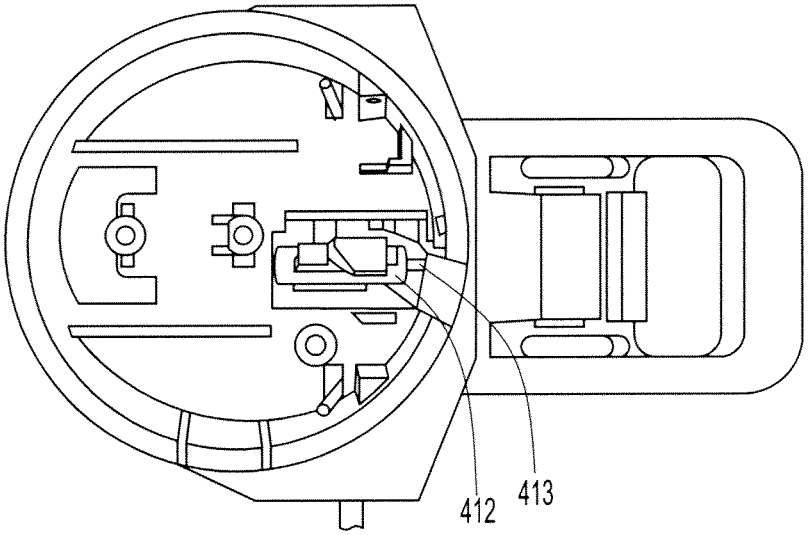
FIGS. 15C and 15D are bottom and top views, respectively, of components of the flipping mechanism of FIG. 13 in second positions.
Figure 15D:
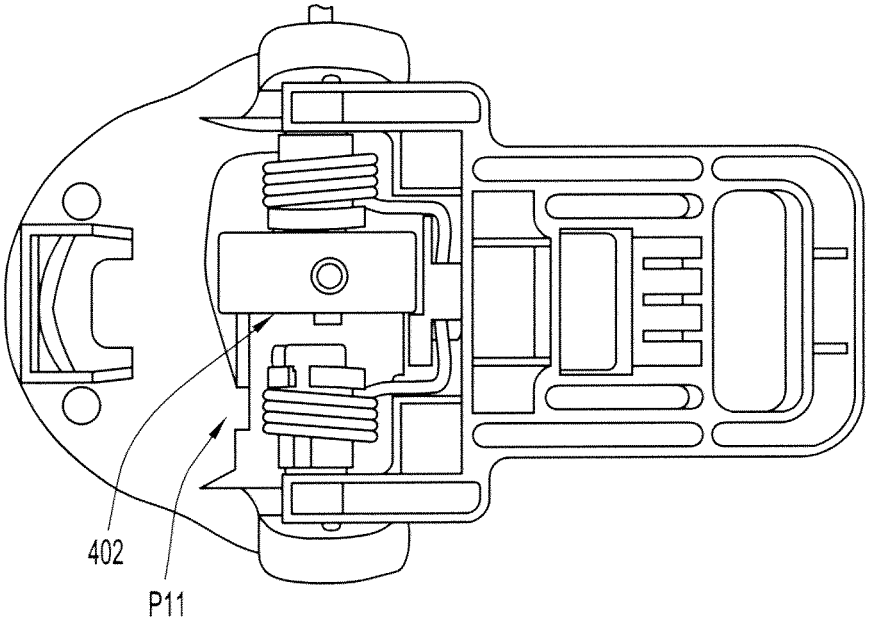

Referring to FIGS. 14-15D, the cam surface 416 is engaged by another projection 265 coupled to or integrally formed with the trigger 262. As the trigger 262 is moved from its raised position P6 (shown in FIG. 13) to its lowered position P7 (shown in FIG. 14), the projection 265 engages the cam surface 416. In turn, the cam surface 416 is pushed outwardly and away from the projection 265, thereby causing the movement member 412 to pivot. Pivotal movement of the movement member 412 is translated into axial movement of the first member 402 of the ratcheting mechanism 400, thereby causing the first member 402 to move from its extended position P10 to its retracted position P11. Referring to FIGS. 15A and 15B, the movement member 412 is in a first position (see FIG. 15A) and the first member 402 is in its extended position P11. Referring to FIGS. 15C and 15D, the movement member 412 has pivoted about pin 413 to its second position (see FIG. 15C) and the first member 402 is moved to its retracted position P11. In this way, the first and second members 402, 404 of the ratcheting mechanism 400 are disengaged when the trigger 262 is actuated (i.e., moved from its raised position P6 to its lowered position P7). The lever 206 is thereby permitted to move from its latched position P1 to its unlatched position P2 which will cause the vehicle T to flip if it is on the support surface S.

Figure 19:
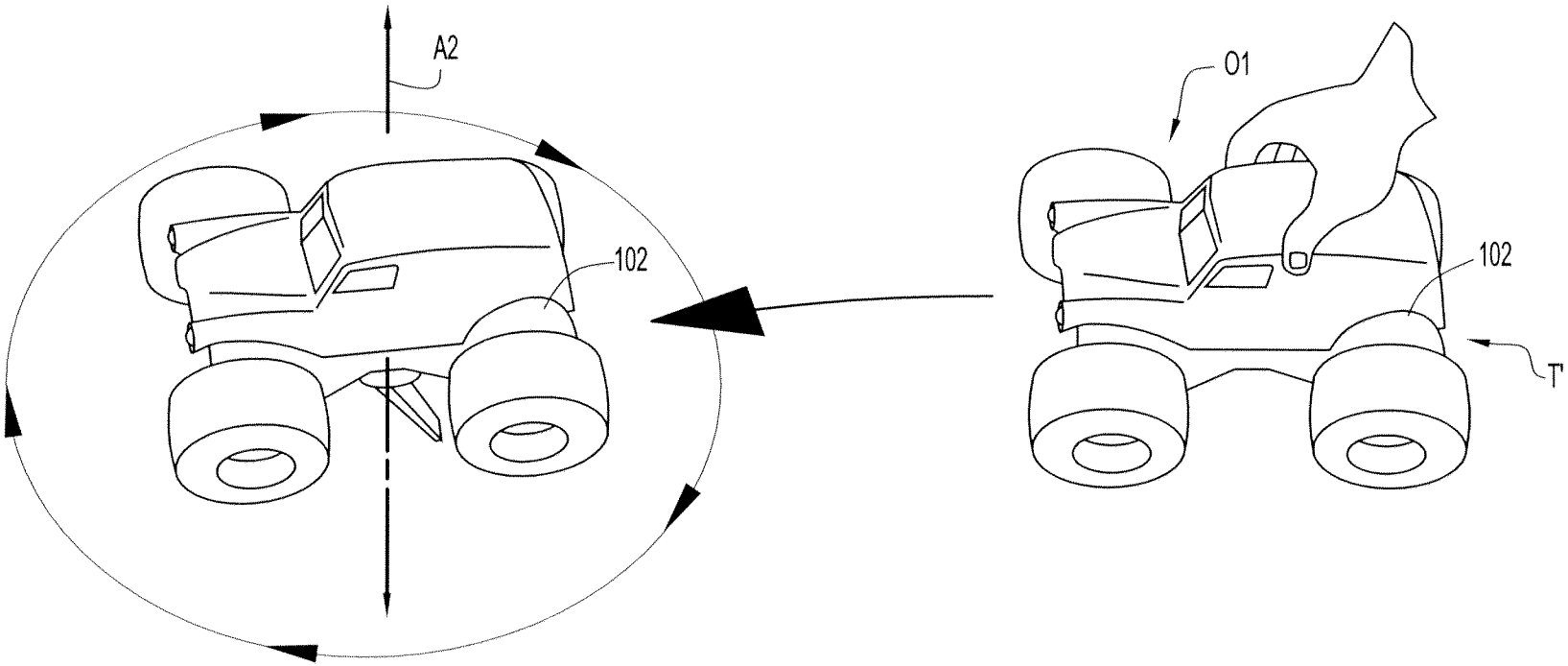
FIG. 19 illustrates a stylized perspective view of a toy vehicle according to another embodiment, showing the vehicle moving from an upright orientation to a spinning mode.

In one embodiment, the toy vehicle T is operable in a flipping mode causing the chassis 102 to be overturned on the support surface S upon actuation of the flipping mechanism 200, as described above. As illustrated in FIG. 19, in an alternative embodiment, a toy vehicle T' is additionally or alternatively operable in a spinning mode causing the chassis 102 to spin about the axis A2, which is substantially perpendicular to the support surface S. Thus, the toy vehicle T' appears to do "donuts" in the spinning mode.

Figure 20:
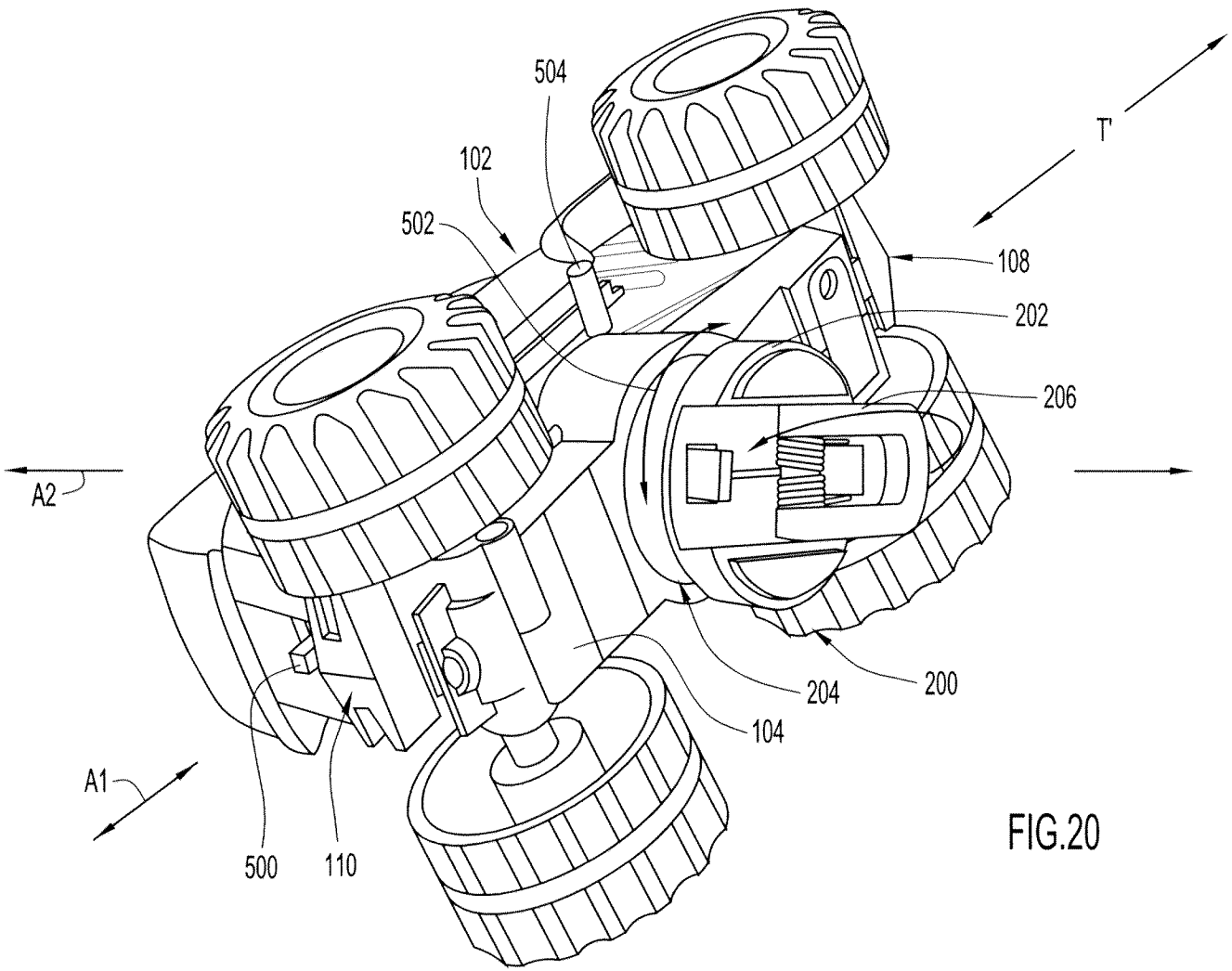
FIG. 20 illustrates a bottom perspective view of the toy vehicle of FIG. 19.

Referring to FIG. 20, in one implementation, the platform 202 is linearly movable along its rotational axis A2 between a retracted position proximate to the underside 104 of the chassis 102, and an extended position spaced from the underside 104 of the chassis 102. The platform 202 is retained in its retracted position via an associated catch (not shown), which is triggered upon actuation of the release mechanism 300.

A switch 500 is provided on the rear end portion 110 of the chassis 102. The switch 500 is coupled to the release mechanism 300. When the switch 500 is disposed in a first position, actuation of the release mechanism 300 triggers the catch associated with the lever 206. Thus, the toy vehicle T' is operable in its flipping mode when the switch 500 is in its first position, as described above. When the switch 500 is disposed in its second position, actuation of the release mechanism 300 triggers the catch associated with linear movement of the platform 202. Thus, the toy vehicle T' is operable in its spinning mode when the switch 500 is in its second position.

With continued reference to FIG. 20, when the platform 202 is disposed in its extended position, it may then be rotated or wound about its rotational axis A2, as shown by arrows 502. The platform 202 is wound against a tensioning member, such as a spring (not shown). In one embodiment, an activation member or button 504 is disposed on the right side 114 (or left side 112) of the chassis 102. Upon depression of the button 504, the platform 202 is permitted to be wound about its rotational axis A2 and against the force of the tensioning member. In one implementation, the button 504 is only depressible when the platform 202 is disposed in its extended position. Once the platform 202 has been sufficiently rotated, and the associated tensioning member compressed, the platform 202 may be pushed inwardly and back to its retracted position. The platform 202 is releasably retained in its retracted position via the associated catch. In addition, rotation of the platform 202 (e.g., unwinding via the forces of the tensioning member) is restricted by the catch.

The platform 202 is moved from its retracted position to its extended position upon actuation of the release mechanism 300 (when the switch 500 is in its second position), which in turn triggers the associated catch. Upon actuation, the platform 202 is thrust outwardly and contacts the support surface S. The platform 202 frictionally contacts the support surface S, so that the rotational forces acting upon the platform 202 via the tensioning mechanism cause the chassis 102 to spin about the rotational axis A2 as the tensioning mechanism de-compresses. Thus, the toy vehicle T' appears to do "donuts," spinning about the rotational axis A2, as shown in FIG. 19.

Thus, in this embodiment, the flipping mechanism or components thereof function as a flipping mechanism for overturning the toy vehicle T' in a selected direction, and also as a spinning mechanism for causing the toy vehicle T' to spin (as shown in FIG. 19). The axis A2 about which the toy vehicle T' spins is substantially perpendicular to the longitudinal axis A1 of the chassis 102, as well as substantially perpendicular to the support surface S.

Figure 21:
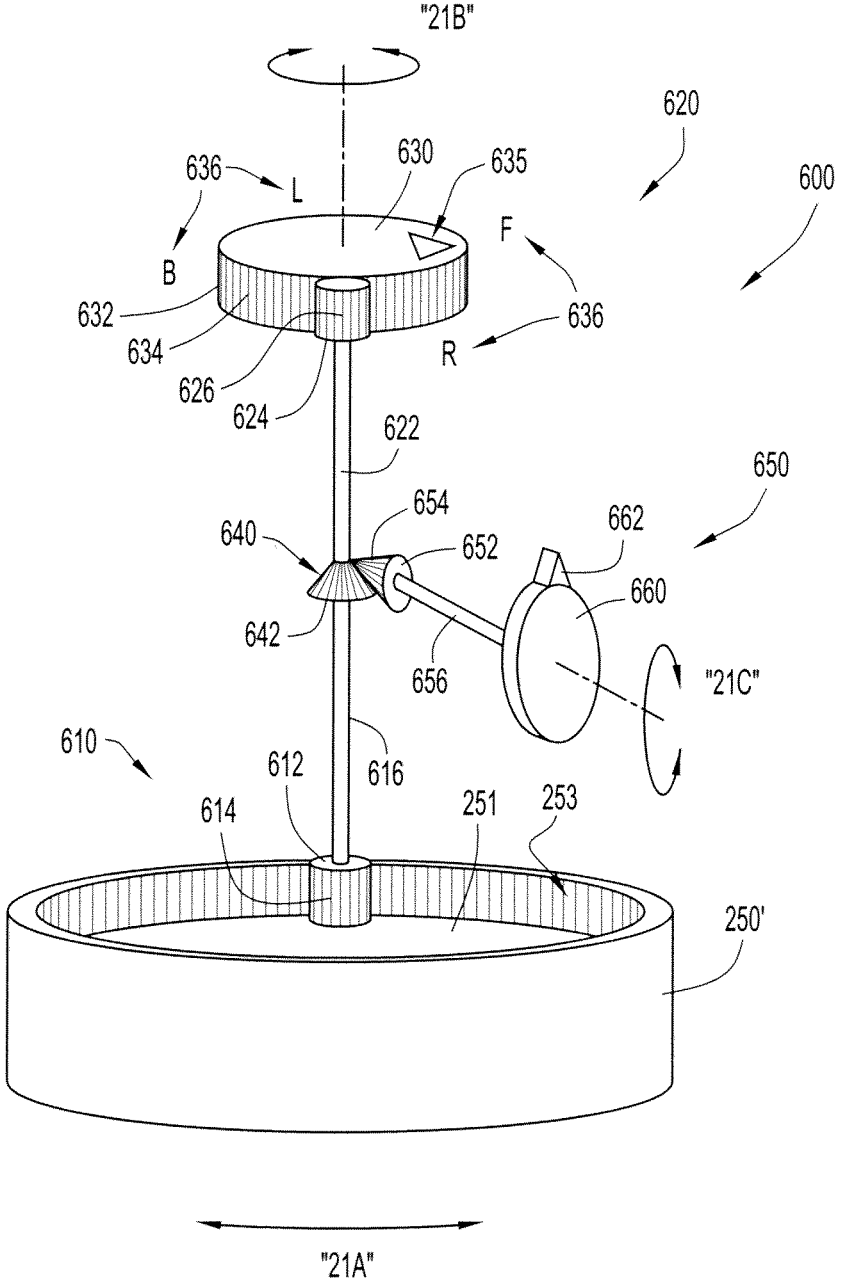
FIG. 21 illustrates a perspective view of some components of different embodiments of an indicator mechanism for use with the toy vehicle of FIG. 1.

Referring to FIG. 21, a perspective view of an indicator mechanism according to the present invention is illustrated. The indicator mechanism is used to provide the user of the toy vehicle with a visual indication of the direction in which the toy vehicle will flip. In one embodiment, the visual indication is provided proximate to an upper surface of the toy vehicle, such as the roof portion of the toy vehicle. In another embodiment, the visual indication is provided proximate to a side surface of the toy vehicle, such as near a door or other side portion of the toy vehicle.

In this embodiment, the indicator mechanism 600 is driven in part by the movement of the upper portion 250' of the flipping mechanism of the toy vehicle. The upper portion 250' illustrated in FIG. 21 is similar to the upper portion 250 described above. However, as shown, the upper portion 250' includes an inner surface 251 that has a rack of teeth formed therealong. A user can rotate the upper portion 250' along either of the directions of arrow "21A" to select the direction in which the toy vehicle is to flip.

The indicator mechanism 600 has a drive portion 610 that includes a pinion gear 612 with teeth 614 positioned to engage the teeth 253 of the upper portion 250'. As the upper portion 250' is rotated, the pinion gear 612 is also rotated. The pinion gear 612 is coupled to an elongate member or shaft 616 that rotates with the pinion gear 612.

The indicator mechanism 600 also includes an output portion that provides the visual indication described above. In FIG. 21, two alternative output portions 620 and 650 are illustrated. It is to be understood that in an embodiment of a toy vehicle according to the present invention, the toy vehicle includes either output portion 620 or output portion 650, and that the output portions 620 and 650 are both illustrated in FIG. 21 for simplicity and ease of reference only. In an alternative embodiment of the toy vehicle, the toy vehicle may include more than one output portion.

Referring to FIG. 21, output portion 620 includes a shaft portion 622, which rotates with shaft 616, and may be integrally formed with shaft 616 or coupled thereto. Coupled to shaft portion 622 is a gear 624 that has an outer surface on which teeth 626 are formed. The output portion 620 also includes an output member 630 that is mounted for rotation along the directions of arrow "21B." The output member 630 has an outer surface 632 with teeth 634 that are engaged with teeth 626. As gear 624 rotates, the output member 630 rotates due to the engagement of teeth 626 with teeth 634. The output member 630 includes an indicator or mark 635 on a surface that is used to point to or indicate one of the directional indicia (F for front, B for back, L for left, and R for right) on the toy vehicle. Based on the position of the indicator 635, which is based on the position of the output member 630 as driven by the upper portion 650', a user can see the particular direction in which the truck is going to flip based on which of the directional indicia is aligned with the indicator 635. In this embodiment, the output member 630 is located proximate to an upper portion of the toy vehicle.

Referring to FIG. 21, the alternative output portion 650 is illustrated as well. In this embodiment, shaft 616 includes a crown gear 640 with teeth 642. The crown gear 640 is mounted to the shaft 616 so that rotation of the shaft 616 results in rotation of the crown gear 640 as well. In this embodiment, the indicator mechanism does not include shaft portion 622.

The output portion 650 includes a gear 652 with teeth 654 that mesh with teeth 642 of gear 640 and cause the rotation of shaft 656 as shaft 616 rotates. An output member 660 with an indicator 662, such as a tab or pointer, is coupled to the shaft 656. Thus, as the upper portion 650' is rotated by the user to place the flipping lever in a desired position, the output member 660 is simultaneously rotated along the corresponding one of the directions of arrow "21C" as well. The indicator 662 is used with indicia, such as directional indicia 636, to indicate the direction in which the toy vehicle is configured to flip.

In one embodiment, the toy vehicle may have one or more openings through which indicator 635 or indicator 662 is viewable. In another embodiment, the body portion of the toy vehicle proximate to indicator 635 or indicator 662 is transparent or translucent, which permits the indicator 635 or indicator 662 to be seen through the body portion.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed is:

1. A toy vehicle, comprising:

a vehicle body having an underside, the toy vehicle being configured to move along a support surface when the vehicle body is disposed in a first orientation;

a platform rotatably coupled to the underside of the vehicle body; and a lever pivotally coupled to the platform, the lever being movable between a first position spaced from the support surface to a second position, the lever contacting the support surface as the lever moves from its first position toward its second position, and the lever causing the vehicle to be overturned or flipped from its first orientation to a second orientation when the lever moves from its first position toward its second position, wherein a direction in which the vehicle body is overturned or flipped when the lever moves from the first position toward the second position is selectable by rotating the platform.

2. The toy vehicle of claim 1, wherein the platform is rotatable about a first axis and the lever is pivotable about a second axis, and the second axis being substantially perpendicular to the first axis.

3. The toy vehicle of claim 2, wherein the vehicle body includes a longitudinal axis, and the first axis extends through and is substantially perpendicular to the longitudinal axis.

4. The toy vehicle of claim 1, wherein the platform is rotatable at least 180 degrees.

5. The toy vehicle of claim 1, wherein the platform is rotatable about a first axis in opposing first and second directions, and the platform is linearly movable toward and away from the underside of the vehicle body in opposing third and fourth directions.

6. The toy vehicle of claim 1, wherein the platform is linearly movable between a first position spaced from the support surface and a second position in contact with the support surface, and the platform causes the vehicle to spin about the first axis when the platform is disposed in its second position.

7. The toy vehicle of claim 1, wherein the lever is releasably secured to the platform via a latch mechanism when the lever is disposed in its first position.

8. The toy vehicle of claim 7, wherein the vehicle body includes a chassis, at least one front wheel rotatably coupled to the chassis, and at least one rear wheel rotatably coupled to the chassis, the chassis is movable between a raised position and a lowered position via a suspension mechanism, the chassis is biased toward its raised position, and the lever is releasably securable to the platform via the latch mechanism by moving the chassis to its lowered position.

9. The toy vehicle of claim 1, wherein the toy vehicle includes a release mechanism coupled to the lever, and the release mechanism releasably retains the lever in its first position until actuated.

10. The toy vehicle of claim 9, wherein the release mechanism is actuated when the vehicle body has traveled along the support surface a predetermined distance.

11. The toy vehicle of claim 9, further comprising:

a safety mechanism coupled to the release mechanism, the safety mechanism preventing actuation of the release mechanism unless the vehicle body is disposed in its first orientation.

12. A toy vehicle, comprising:

a chassis including an underside, a front end portion and a rear end portion, at least one front wheel rotatably coupled to the front end portion, at least one rear wheel rotatably coupled to the rear end portion, and a platform rotatably coupled to the underside of the chassis;

a flipping mechanism movably coupled to the platform, the flipping mechanism including a lever that is selectively repositionable between a first position in which the rear end portion flips upwardly and over the front end portion in a first direction upon actuation of the flipping mechanism, and a second position in which the front end portion flips upwardly and over the rear end portion in a second direction upon actuation of the flipping mechanism.

13. The toy vehicle of claim 12, wherein the flipping mechanism is rotatable at least 180 degrees relative to the chassis, and the toy vehicle is overturnable on a support surface in a selected direction in between the first and second directions.

14. The toy vehicle of claim 12, wherein the flipping mechanism is rotatable about a first axis, and the chassis has a longitudinal axis substantially perpendicular to the first axis.

15. The toy vehicle of claim 12, wherein the flipping mechanism is operable in a first mode and a second mode, the flipping mechanism in the first mode causes the chassis to be overturned on a support surface upon actuation, and the flipping mechanism in the second mode causes the chassis to spin about an axis substantially perpendicular to the surface.

16. A toy vehicle, comprising:

a wheeled vehicle body configured to move along a support surface when disposed in a first orientation;

a spinning mechanism coupled to an underside of the vehicle body, the spinning mechanism including an engagement member selectively movable between a first position spaced from the support surface and a second position in contact with the support surface, the engagement member causing the vehicle to spin about an axis when the engagement member is disposed in its second position and the vehicle is disposed in its first orientation.

17. The toy vehicle of claim 16, wherein the vehicle body includes a longitudinal axis, and the axis about which the vehicle spins is substantially perpendicular to the longitudinal axis of the vehicle body.

* * * * *